US008800107B2

(12) United States Patent
Blouin

(10) Patent No.: US 8,800,107 B2
(45) Date of Patent: Aug. 12, 2014

(54) VACUUM BRUSH

(75) Inventor: Matthew Blouin, Townsend, MA (US)

(73) Assignee: iRobot Corporation, Bedford, MA (US)

( * ) Notice: Subject to any disclaimer, the term of this patent is extended or adjusted under 35 U.S.C. 154(b) by 107 days.

(21) Appl. No.: 13/028,996

(22) Filed: Feb. 16, 2011

(65) Prior Publication Data

US 2011/0252594 A1 Oct. 20, 2011

Related U.S. Application Data

(60) Provisional application No. 61/304,886, filed on Feb. 16, 2010.

(51) Int. Cl.
*A47L 9/04* (2006.01)

(52) U.S. Cl.
CPC ..... *A47L 9/0477* (2013.01); *A47L 9/0455* (2013.01)
USPC ..... 15/392; 15/389; 15/384

(58) Field of Classification Search
USPC ..... 15/389, 392, 383, 384, 327.2, 391, 179, 15/41.1, 42–46, 141.2; 384/480, 465, 471
See application file for complete search history.

(56) References Cited

U.S. PATENT DOCUMENTS

| | | | | |
|---|---|---|---|---|
| 1,755,054 | A | 4/1930 | Darst | |
| 1,780,221 | A | 11/1930 | Buchmann | |
| 1,970,302 | A | 8/1934 | Gerhardt | |
| 1,999,696 | A * | 4/1935 | Kitto | 15/179 |
| 2,136,324 | A | 11/1938 | John | |
| 2,302,111 | A | 11/1942 | Dow et al. | |
| 2,353,621 | A | 7/1944 | Sav et al. | |
| 2,770,825 | A | 11/1956 | Pullen | |
| 3,119,369 | A | 1/1964 | Harland et al. | |
| 3,166,138 | A | 1/1965 | Dunn | |
| 3,216,047 | A * | 11/1965 | Ernolf | 15/385 |
| 3,333,564 | A | 8/1967 | Waters | |
| 3,375,375 | A | 3/1968 | Robert et al. | |
| 3,381,652 | A | 5/1968 | Schaefer et al. | |
| 3,457,575 | A | 7/1969 | Bienek | |
| 3,550,714 | A | 12/1970 | Bellinger | |

(Continued)

FOREIGN PATENT DOCUMENTS

| | | | |
|---|---|---|---|
| AU | 2003275566 | A1 | 6/2004 |
| DE | 2128842 | A1 | 12/1972 |

(Continued)

OTHER PUBLICATIONS

International Search Report and Written Opinion for PCT/US2011/025095, dated May 30, 2011.

(Continued)

*Primary Examiner* — Mark Spisich
*Assistant Examiner* — Andrew A Horton
(74) *Attorney, Agent, or Firm* — Honigman Miller Schwartz and Cohn LLP

(57) ABSTRACT

A rotating cleaning element configured to be inserted in a cleaning head compartment of a robotic vacuum, the rotating cleaning element including: a drive end including a drive protrusion configured to engage a drive mechanism of the cleaning head compartment; a bearing end and a shroud configured to surround at least a portion of the bearing end to lessen an amount of hair and similar matter that reaches the bearing; and a central member extending between the bearing end and the drive end.

18 Claims, 23 Drawing Sheets

(56) References Cited

U.S. PATENT DOCUMENTS 3,569,727 A 3/1971 Aggarwal et al.
3,639,941 A * 2/1972 Kirwan et al. ..... 15/372
3,674,316 A 7/1972 De Brey
3,678,882 A 7/1972 Kinsella
3,744,586 A 7/1973 Leinauer
3,756,667 A 9/1973 Bombardier et al.
3,809,004 A 5/1974 Leonheart
3,816,004 A 6/1974 Bignardi
3,845,831 A 11/1974 James
RE28,268 E 12/1974 Autrand
3,853,086 A 12/1974 Asplund
3,863,285 A 2/1975 Hukuba
3,888,181 A 6/1975 Kups
3,937,174 A 2/1976 Haaga
3,952,361 A 4/1976 Wilkins
3,989,311 A 11/1976 Debrey
3,989,931 A 11/1976 Phillips
3,993,017 A 11/1976 De Brey
4,004,313 A 1/1977 Capra
4,012,681 A 3/1977 Finger et al.
4,070,170 A 1/1978 Leinfelt
4,099,284 A 7/1978 Shinozaki et al.
4,119,900 A 10/1978 Kremnitz
4,175,589 A 11/1979 Nakamura et al.
4,175,892 A 11/1979 De brey
4,196,727 A 4/1980 Verkaart et al.
4,198,727 A 4/1980 Farmer
4,199,838 A 4/1980 Simonsson
4,209,254 A 6/1980 Reymond et al.
D258,901 S 4/1981 Keyworth
4,297,578 A 10/1981 Carter
4,306,329 A 12/1981 Yokoi
4,309,758 A 1/1982 Halsall et al.
4,328,545 A 5/1982 Halsall et al.
4,367,403 A 1/1983 Miller
4,369,543 A 1/1983 Chen et al.
4,401,909 A 8/1983 Gorsek
4,416,033 A 11/1983 Specht
4,445,245 A 5/1984 Lu
4,465,370 A 8/1984 Yuasa et al.
4,477,998 A 10/1984 You
4,481,692 A 11/1984 Kurz
4,482,960 A 11/1984 Pryor
4,492,058 A 1/1985 Goldfarb et al.
4,513,469 A 4/1985 Godfrey et al.
D278,732 S 5/1985 Ohkado
4,518,437 A 5/1985 Sommer
4,534,637 A 8/1985 Suzuki et al.
4,556,313 A 12/1985 Miller et al.
4,575,211 A 3/1986 Matsumura et al.
4,580,311 A 4/1986 Kurz
4,601,082 A 7/1986 Kurz
4,618,213 A 10/1986 Chen
4,620,285 A 10/1986 Perdue
4,624,026 A 11/1986 Olson et al.
4,626,995 A 12/1986 Lofgren et al.
4,628,454 A 12/1986 Ito
4,638,445 A 1/1987 Mattaboni
4,644,156 A 2/1987 Takahashi et al.
4,649,504 A 3/1987 Krouglicof et al.
4,652,917 A 3/1987 Miller
4,654,492 A 3/1987 Koerner et al.
4,654,924 A 4/1987 Getz et al.
4,660,969 A 4/1987 Sorimachi et al.
4,662,854 A 5/1987 Fang
4,674,048 A 6/1987 Okumura
4,679,152 A 7/1987 Perdue
4,680,827 A 7/1987 Hummel
4,696,074 A 9/1987 Cavalli et al.
D292,223 S 10/1987 Trumbull
4,700,301 A 10/1987 Dyke
4,700,427 A 10/1987 Knepper
4,703,820 A 11/1987 Reinaud
4,710,020 A 12/1987 Maddox et al.
4,716,621 A 1/1988 Zoni
4,728,801 A 3/1988 O'Connor
4,733,343 A 3/1988 Yoneda et al.
4,733,430 A 3/1988 Westergren
4,733,431 A 3/1988 Martin
4,735,136 A 4/1988 Lee et al.
4,735,138 A 4/1988 Gawler et al.
4,748,336 A 5/1988 Fujie et al.
4,748,833 A 6/1988 Nagasawa
4,756,049 A 7/1988 Uehara
4,767,213 A 8/1988 Hummel
4,769,700 A 9/1988 Pryor
4,777,416 A 10/1988 George, II et al.
D298,766 S 11/1988 Tanno et al.
4,782,550 A 11/1988 Jacobs
4,796,198 A 1/1989 Boultinghouse et al.
4,806,751 A 2/1989 Abe et al.
4,811,228 A 3/1989 Hyyppa
4,813,906 A 3/1989 Matsuyama et al.
4,815,157 A 3/1989 Tsuchiya
4,817,000 A 3/1989 Eberhardt
4,818,875 A 4/1989 Weiner
4,829,442 A 5/1989 Kadonoff et al.
4,829,626 A 5/1989 Harkonen et al.
4,832,098 A 5/1989 Palinkas et al.
4,851,661 A 7/1989 Everett
4,854,000 A 8/1989 Takimoto
4,854,006 A 8/1989 Nishimura et al.
4,855,915 A 8/1989 Dallaire
4,857,912 A 8/1989 Everett et al.
4,858,132 A 8/1989 Holmquist
4,867,570 A 9/1989 Sorimachi et al.
4,880,474 A 11/1989 Koharagi et al.
4,887,415 A 12/1989 Martin
4,891,762 A 1/1990 Chotiros
4,893,025 A 1/1990 Lee
4,901,394 A 2/1990 Nakamura et al.
4,905,151 A 2/1990 Weiman et al.
4,912,643 A 3/1990 Beirne
4,918,441 A 4/1990 Bohman
4,919,224 A 4/1990 Shyu et al.
4,919,489 A 4/1990 Kopsco
4,920,060 A 4/1990 Parrent et al.
4,920,605 A 5/1990 Takashima
4,933,864 A 6/1990 Evans, Jr. et al.
4,937,912 A 7/1990 Kurz
4,953,253 A 9/1990 Fukuda et al.
4,954,962 A 9/1990 Evans et al.
4,955,714 A 9/1990 Stotler et al.
4,956,891 A 9/1990 Wulff
4,961,303 A 10/1990 McCarty et al.
4,961,304 A 10/1990 Ovsborn et al.
4,962,453 A 10/1990 Pong, Jr. et al.
4,971,591 A 11/1990 Raviv et al.
4,973,912 A 11/1990 Kaminski et al.
4,974,283 A 12/1990 Holsten et al.
4,977,618 A 12/1990 Allen
4,977,639 A 12/1990 Takahashi et al.
4,986,663 A 1/1991 Cecchi et al.
5,001,635 A 3/1991 Yasutomi et al.
5,002,145 A 3/1991 Wakaumi et al.
5,012,886 A 5/1991 Jonas et al.
5,018,240 A 5/1991 Holman
5,020,186 A 6/1991 Lessig et al.
5,022,812 A 6/1991 Coughlan et al.
5,023,788 A 6/1991 Kitazume et al.
5,024,529 A 6/1991 Svetkoff et al.
D318,500 S 7/1991 Malewicki et al.
5,032,775 A 7/1991 Mizuno et al.
5,033,151 A 7/1991 Kraft et al.
5,033,291 A 7/1991 Podoloff et al.
5,040,116 A 8/1991 Evans et al.
5,045,769 A 9/1991 Everett
5,049,802 A 9/1991 Mintus et al.
5,051,906 A 9/1991 Evans et al.
5,062,819 A 11/1991 Mallory
5,070,567 A 12/1991 Holland
5,084,934 A 2/1992 Lessig et al.
5,086,535 A 2/1992 Grossmeyer et al.
5,090,321 A 2/1992 Abouav

(56) References Cited

U.S. PATENT DOCUMENTS 5,093,955 A 3/1992 Blehert et al.
5,094,311 A 3/1992 Akeel
5,105,502 A 4/1992 Takashima
5,105,550 A 4/1992 Shenoha
5,109,566 A 5/1992 Kobayashi et al.
5,115,538 A 5/1992 Cochran et al.
5,127,128 A 7/1992 Lee
5,136,675 A 8/1992 Hodson
5,136,750 A 8/1992 Takashima et al.
5,142,985 A 9/1992 Stearns et al.
5,144,471 A 9/1992 Takanashi et al.
5,144,714 A 9/1992 Mod et al.
5,144,715 A 9/1992 Matsuyo et al.
5,152,028 A 10/1992 Hirano
5,152,202 A 10/1992 Strauss
5,155,684 A 10/1992 Burke et al.
5,163,202 A 11/1992 Kawakami et al.
5,163,320 A 11/1992 Goshima et al.
5,164,579 A 11/1992 Pryor et al.
5,165,064 A 11/1992 Mattaboni
5,170,352 A 12/1992 McTamaney et al.
5,173,881 A 12/1992 Sindle
5,182,833 A 2/1993 Yamaguchi et al.
5,202,742 A 4/1993 Frank et al.
5,204,814 A 4/1993 Noonan et al.
5,206,500 A 4/1993 Decker et al.
5,208,521 A 5/1993 Aoyama
5,216,777 A 6/1993 Moro et al.
5,227,985 A 7/1993 DeMenthon
5,233,682 A 8/1993 Abe et al.
5,239,720 A 8/1993 Wood et al.
5,251,358 A 10/1993 Moro et al.
5,261,139 A 11/1993 Lewis
5,272,785 A * 12/1993 Stegens ..... 15/179
5,276,618 A 1/1994 Everett
5,276,939 A 1/1994 Uenishi
5,277,064 A 1/1994 Knigga et al.
5,279,672 A 1/1994 Betker et al.
5,284,452 A 2/1994 Corona
5,284,522 A 2/1994 Kobayashi et al.
5,293,955 A 3/1994 Lee
D345,707 S 4/1994 Alister
5,303,448 A 4/1994 Hennessey et al.
5,307,273 A 4/1994 Oh et al.
5,309,592 A 5/1994 Hiratsuka
5,310,379 A 5/1994 Hippely et al.
5,315,227 A 5/1994 Pierson et al.
5,319,827 A 6/1994 Yang
5,319,828 A 6/1994 Waldhauser et al.
5,321,614 A 6/1994 Ashworth
5,323,483 A 6/1994 Baeg
5,324,948 A 6/1994 Dudar et al.
5,341,186 A 8/1994 Kato
5,341,540 A 8/1994 Soupert et al.
5,341,549 A 8/1994 Wirtz et al.
5,345,649 A 9/1994 Whitlow
5,353,224 A 10/1994 Lee et al.
5,363,305 A 11/1994 Cox et al.
5,363,935 A 11/1994 Schempf et al.
5,369,347 A 11/1994 Yoo
5,369,838 A 12/1994 Wood et al.
5,386,862 A 2/1995 Glover et al.
5,399,951 A 3/1995 Lavallee et al.
5,400,244 A 3/1995 Watanabe et al.
5,404,612 A 4/1995 Ishikawa
5,410,479 A 4/1995 Coker
5,435,038 A * 7/1995 Sauers ..... 15/182
5,435,405 A 7/1995 Schempf et al.
5,440,216 A 8/1995 Kim
5,442,358 A 8/1995 Keeler et al.
5,444,965 A 8/1995 Colens
5,446,356 A 8/1995 Kim
5,446,445 A 8/1995 Bloomfield et al.
5,451,135 A 9/1995 Schempf et al.
5,452,490 A * 9/1995 Brundula et al. ..... 15/182
5,454,129 A 10/1995 Kell
5,455,982 A 10/1995 Armstrong et al.
5,465,451 A * 11/1995 Stegens ..... 15/179
5,465,525 A 11/1995 Mifune et al.
5,465,619 A 11/1995 Sotack et al.
5,467,273 A 11/1995 Faibish et al.
5,471,560 A 11/1995 Allard et al.
5,491,670 A 2/1996 Weber
5,497,529 A 3/1996 Boesi et al.
5,498,948 A 3/1996 Bruni et al.
5,502,638 A 3/1996 Takenaka
5,505,072 A 4/1996 Oreper
5,507,067 A 4/1996 Hoekstra et al.
5,510,893 A 4/1996 Suzuki
5,511,147 A 4/1996 Abdel
5,515,572 A 5/1996 Hoekstra et al.
5,534,762 A 7/1996 Kim
5,537,017 A 7/1996 Feiten et al.
5,537,711 A 7/1996 Tseng
5,539,953 A 7/1996 Kurz
5,542,146 A 8/1996 Hoekstra et al.
5,542,148 A 8/1996 Young
5,546,631 A 8/1996 Chambon
5,548,511 A 8/1996 Bancroft
5,551,525 A 9/1996 Pack et al.
5,553,349 A 9/1996 Kilstrom et al.
5,555,587 A 9/1996 Guha
5,560,077 A 10/1996 Crotchett
5,568,589 A 10/1996 Hwang
D375,592 S 11/1996 Ljunggren
5,608,306 A 3/1997 Rybeck et al.
5,608,894 A 3/1997 Kawakami et al.
5,608,944 A 3/1997 Gordon
5,610,488 A 3/1997 Miyazawa
5,611,106 A 3/1997 Wulff
5,611,108 A 3/1997 Knowlton et al.
5,613,261 A 3/1997 Kawakami et al.
5,613,269 A 3/1997 Miwa
5,621,291 A 4/1997 Lee
5,622,236 A 4/1997 Azumi et al.
5,634,237 A 6/1997 Paranjpe
5,634,239 A 6/1997 Tuvin et al.
5,636,402 A 6/1997 Kubo et al.
5,642,299 A 6/1997 Hardin et al.
5,646,494 A 7/1997 Han
5,647,554 A 7/1997 Ikegami et al.
5,650,702 A 7/1997 Azumi
5,652,489 A 7/1997 Kawakami
5,682,313 A 10/1997 Edlund et al.
5,682,839 A 11/1997 Grimsley et al.
5,696,675 A 12/1997 Nakamura et al.
5,698,861 A 12/1997 Oh
5,709,007 A 1/1998 Chiang
5,710,506 A 1/1998 Broell et al.
5,714,119 A 2/1998 Kawagoe et al.
5,717,169 A 2/1998 Liang et al.
5,717,484 A 2/1998 Hamaguchi et al.
5,720,077 A 2/1998 Nakamura et al.
5,732,401 A 3/1998 Conway
5,735,959 A 4/1998 Kubo et al.
5,745,235 A 4/1998 Vercammen et al.
5,752,871 A 5/1998 Tsuzuki
5,756,904 A 5/1998 Oreper et al.
5,761,762 A 6/1998 Kubo
5,764,888 A 6/1998 Bolan et al.
5,767,437 A 6/1998 Rogers
5,767,960 A 6/1998 Orman
5,777,596 A 7/1998 Herbert
5,778,486 A 7/1998 Kim
5,781,697 A 7/1998 Jeong
5,781,960 A 7/1998 Kilstrom et al.
5,786,602 A 7/1998 Pryor et al.
5,787,545 A 8/1998 Colens
5,793,900 A 8/1998 Nourbakhsh et al.
5,794,297 A 8/1998 Muta
5,812,267 A 9/1998 Everett et al.
5,814,808 A 9/1998 Takada et al.
5,815,880 A 10/1998 Nakanishi
5,815,884 A 10/1998 Imamura et al.

(56) References Cited

U.S. PATENT DOCUMENTS 5,819,008 A 10/1998 Asama et al.
5,819,360 A 10/1998 Fujii
5,819,936 A 10/1998 Saveliev et al.
5,820,821 A 10/1998 Kawagoe et al.
5,821,730 A 10/1998 Drapkin
5,825,981 A 10/1998 Matsuda
5,828,770 A 10/1998 Leis et al.
5,831,597 A 11/1998 West et al.
5,839,156 A 11/1998 Park et al.
5,839,532 A 11/1998 Yoshiji et al.
5,841,259 A 11/1998 Kim et al.
5,867,800 A 2/1999 Leif
5,869,910 A 2/1999 Colens
5,896,611 A 4/1999 Haaga
5,903,124 A 5/1999 Kawakami
5,905,209 A 5/1999 Oreper
5,907,886 A 6/1999 Buscher
5,910,700 A 6/1999 Crotzer
5,911,260 A 6/1999 Suzuki
5,916,008 A 6/1999 Wong
5,924,167 A 7/1999 Wright et al.
5,926,909 A 7/1999 McGee
5,933,102 A 8/1999 Miller et al.
5,933,913 A 8/1999 Wright et al.
5,935,179 A 8/1999 Kleiner et al.
5,940,346 A 8/1999 Sadowsky et al.
5,940,927 A 8/1999 Haegermarck et al.
5,940,930 A 8/1999 Oh et al.
5,942,869 A 8/1999 Katou et al.
5,943,730 A 8/1999 Boomgaarden
5,943,733 A 8/1999 Tagliaferri
5,947,225 A 9/1999 Kawakami et al.
5,950,408 A 9/1999 Schaedler
5,959,423 A 9/1999 Nakanishi et al.
5,968,281 A 10/1999 Wright et al.
5,974,348 A 10/1999 Rocks
5,974,365 A 10/1999 Mitchell
5,983,448 A 11/1999 Wright et al.
5,984,880 A 11/1999 Lander et al.
5,987,383 A 11/1999 Keller et al.
5,989,700 A 11/1999 Krivopal
5,991,951 A 11/1999 Kubo et al.
5,995,883 A 11/1999 Nishikado
5,995,884 A 11/1999 Allen et al.
5,996,167 A 12/1999 Close
5,998,953 A 12/1999 Nakamura et al.
5,998,971 A 12/1999 Corbridge
6,000,088 A 12/1999 Wright et al.
6,003,198 A * 12/1999 Stegens ..... 15/392
6,009,358 A 12/1999 Angott et al.
6,021,545 A 2/2000 Delgado et al.
6,023,813 A 2/2000 Thatcher et al.
6,023,814 A 2/2000 Imamura
6,025,687 A 2/2000 Himeda et al.
6,026,539 A 2/2000 Mouw et al.
6,030,464 A 2/2000 Azevedo
6,030,465 A 2/2000 Marcussen et al.
6,032,542 A 3/2000 Warnick et al.
6,036,572 A 3/2000 Sze
6,038,501 A 3/2000 Kawakami
6,040,669 A 3/2000 Hog
6,041,471 A 3/2000 Charky et al.
6,041,472 A 3/2000 Kasen et al.
6,046,800 A 4/2000 Ohtomo et al.
6,049,620 A 4/2000 Dickinson et al.
6,052,821 A 4/2000 Chouly et al.
6,055,042 A 4/2000 Sarangapani
6,055,702 A 5/2000 Imamura et al.
6,061,868 A 5/2000 Moritsch et al.
6,065,182 A 5/2000 Wright et al.
6,073,432 A 6/2000 Schaedler
6,076,025 A 6/2000 Ueno et al.
6,076,026 A 6/2000 Jambhekar et al.
6,076,226 A 6/2000 Reed
6,076,227 A 6/2000 Schallig et al.
6,081,257 A 6/2000 Zeller
6,088,020 A 7/2000 Mor
6,094,775 A 8/2000 Behmer
6,099,091 A 8/2000 Campbell
6,101,670 A 8/2000 Song
6,101,671 A 8/2000 Wright et al.
6,108,031 A 8/2000 King et al.
6,108,067 A 8/2000 Okamoto
6,108,076 A 8/2000 Hanseder
6,108,269 A 8/2000 Kabel
6,108,597 A 8/2000 Kirchner et al.
6,112,143 A 8/2000 Allen et al.
6,112,996 A 9/2000 Matsuo
6,119,057 A 9/2000 Kawagoe
6,122,798 A 9/2000 Kobayashi et al.
6,124,694 A 9/2000 Bancroft et al.
6,125,498 A 10/2000 Roberts et al.
6,131,237 A 10/2000 Kasper et al.
6,138,063 A 10/2000 Himeda
6,142,252 A 11/2000 Kinto et al.
6,146,278 A 11/2000 Kobayashi
6,154,279 A 11/2000 Thayer
6,154,694 A 11/2000 Aoki et al.
6,160,479 A 12/2000 Åhlén et al.
6,167,332 A 12/2000 Kurtzberg et al.
6,167,587 B1 1/2001 Kasper et al.
6,192,548 B1 2/2001 Huffman
6,216,307 B1 4/2001 Kaleta et al.
6,220,865 B1 4/2001 Macri et al.
6,226,830 B1 5/2001 Hendriks et al.
6,230,362 B1 5/2001 Kasper et al.
6,237,741 B1 5/2001 Guidetti
6,240,342 B1 5/2001 Fiegert et al.
6,243,913 B1 6/2001 Frank et al.
6,255,793 B1 7/2001 Peless et al.
6,259,979 B1 7/2001 Holmquist
6,261,379 B1 7/2001 Conrad et al.
6,263,539 B1 7/2001 Baig
6,263,989 B1 7/2001 Won
6,272,936 B1 8/2001 Oreper et al.
6,276,478 B1 8/2001 Hopkins et al.
6,278,918 B1 8/2001 Dickson et al.
6,282,526 B1 8/2001 Ganesh
6,283,034 B1 9/2001 Miles
6,285,778 B1 9/2001 Nakajima et al.
6,285,930 B1 9/2001 Dickson et al.
6,300,737 B1 10/2001 Bergvall et al.
6,321,337 B1 11/2001 Reshef et al.
6,321,515 B1 11/2001 Colens
6,323,570 B1 11/2001 Nishimura et al.
6,324,714 B1 12/2001 Walz et al.
6,327,741 B1 12/2001 Reed
6,332,400 B1 12/2001 Meyer
6,339,735 B1 1/2002 Peless et al.
6,362,875 B1 3/2002 Burkley
6,370,453 B2 4/2002 Sommer
6,374,155 B1 4/2002 Wallach et al.
6,374,157 B1 4/2002 Takamura
6,381,802 B2 5/2002 Park
6,385,515 B1 5/2002 Dickson et al.
6,388,013 B1 5/2002 Saraf et al.
6,389,329 B1 5/2002 Colens
6,400,048 B1 6/2002 Nishimura et al.
6,401,294 B2 6/2002 Kasper
6,408,226 B1 6/2002 Byrne et al.
6,412,141 B2 7/2002 Kasper et al.
6,415,203 B1 7/2002 Inoue et al.
6,421,870 B1 7/2002 Basham et al.
6,427,285 B1 8/2002 Legatt et al.
6,430,471 B1 8/2002 Kintou et al.
6,431,296 B1 8/2002 Won
6,437,227 B1 8/2002 Theimer
6,437,465 B1 8/2002 Nishimura et al.
6,438,456 B1 8/2002 Feddema et al.
6,438,793 B1 8/2002 Miner et al.
6,442,476 B1 8/2002 Poropat
6,443,509 B1 9/2002 Levin et al.
6,444,003 B1 9/2002 Sutcliffe
6,446,302 B1 9/2002 Kasper et al.

(56) References Cited

U.S. PATENT DOCUMENTS

| | | | |
|---|---|---|---|
| 6,454,036 | B1 | 9/2002 | Airey et al. |
| D464,091 | S | 10/2002 | Christianson |
| 6,457,206 | B1 | 10/2002 | Judson |
| 6,459,955 | B1 | 10/2002 | Bartsch et al. |
| 6,463,368 | B1 | 10/2002 | Feiten et al. |
| 6,465,982 | B1 | 10/2002 | Bergvall et al. |
| 6,473,167 | B1 | 10/2002 | Odell |
| 6,480,762 | B1 | 11/2002 | Uchikubo et al. |
| 6,481,515 | B1 | 11/2002 | Kirkpatrick et al. |
| 6,490,539 | B1 | 12/2002 | Dickson et al. |
| 6,491,127 | B1 | 12/2002 | Holmberg et al. |
| 6,493,612 | B1 | 12/2002 | Bisset et al. |
| 6,493,613 | B2 | 12/2002 | Peless et al. |
| 6,496,754 | B2 | 12/2002 | Song et al. |
| 6,496,755 | B2 | 12/2002 | Wallach et al. |
| 6,502,657 | B2 | 1/2003 | Kerrebrock et al. |
| 6,504,610 | B1 | 1/2003 | Bauer et al. |
| 6,507,773 | B2 | 1/2003 | Parker et al. |
| 6,525,509 | B1 | 2/2003 | Petersson et al. |
| D471,243 | S | 3/2003 | Cioffi et al. |
| 6,532,404 | B2 | 3/2003 | Colens |
| 6,535,793 | B2 | 3/2003 | Allard |
| 6,540,607 | B2 | 4/2003 | Mokris et al. |
| 6,548,982 | B1 | 4/2003 | Papanikolopoulos et al. |
| 6,553,612 | B1 | 4/2003 | Dyson et al. |
| 6,556,722 | B1 | 4/2003 | Russell et al. |
| 6,556,892 | B2 | 4/2003 | Kuroki et al. |
| 6,557,104 | B2 | 4/2003 | Vu et al. |
| D474,312 | S | 5/2003 | Stephens et al. |
| 6,563,130 | B2 | 5/2003 | Dworkowski et al. |
| 6,571,415 | B2 | 6/2003 | Gerber et al. |
| 6,571,422 | B1 | 6/2003 | Gordon et al. |
| 6,572,711 | B2 | 6/2003 | Sclafani et al. |
| 6,574,536 | B1 | 6/2003 | Kawagoe et al. |
| 6,580,246 | B2 | 6/2003 | Jacobs |
| 6,584,376 | B1 | 6/2003 | Van Kommer |
| 6,586,908 | B2 | 7/2003 | Petersson et al. |
| 6,587,573 | B1 | 7/2003 | Stam et al. |
| 6,590,222 | B1 | 7/2003 | Bisset et al. |
| 6,594,551 | B2 | 7/2003 | McKinney et al. |
| 6,594,844 | B2 | 7/2003 | Jones |
| D478,884 | S | 8/2003 | Slipy et al. |
| 6,601,265 | B1 | 8/2003 | Burlington |
| 6,604,021 | B2 | 8/2003 | Imai et al. |
| 6,604,022 | B2 | 8/2003 | Parker et al. |
| 6,605,156 | B1 | 8/2003 | Clark et al. |
| 6,611,120 | B2 | 8/2003 | Song et al. |
| 6,611,734 | B2 | 8/2003 | Parker et al. |
| 6,611,738 | B2 | 8/2003 | Ruffner |
| 6,615,108 | B1 | 9/2003 | Peless et al. |
| 6,615,885 | B1 | 9/2003 | Ohm |
| 6,622,465 | B2 | 9/2003 | Jerome et al. |
| 6,624,744 | B1 | 9/2003 | Wilson et al. |
| 6,625,843 | B2 | 9/2003 | Kim et al. |
| 6,629,028 | B2 | 9/2003 | Paromtchik et al. |
| 6,639,659 | B2 | 10/2003 | Granger |
| 6,658,325 | B2 | 12/2003 | Zweig |
| 6,658,354 | B2 | 12/2003 | Lin |
| 6,658,692 | B2 | 12/2003 | Lenkiewicz et al. |
| 6,658,693 | B1 | 12/2003 | Reed, Jr. |
| 6,661,239 | B1 | 12/2003 | Ozick |
| 6,662,889 | B2 | 12/2003 | De Fazio et al. |
| 6,668,951 | B2 | 12/2003 | Won |
| 6,670,817 | B2 | 12/2003 | Fournier et al. |
| 6,671,592 | B1 | 12/2003 | Bisset et al. |
| 6,687,571 | B1 | 2/2004 | Byrne et al. |
| 6,690,134 | B1 | 2/2004 | Jones et al. |
| 6,690,993 | B2 | 2/2004 | Foulke et al. |
| 6,697,147 | B2 | 2/2004 | Ko et al. |
| 6,711,280 | B2 | 3/2004 | Stafsudd et al. |
| 6,732,826 | B2 | 5/2004 | Song et al. |
| 6,737,591 | B1 | 5/2004 | Lapstun et al. |
| 6,741,054 | B2 | 5/2004 | Koselka et al. |
| 6,741,364 | B2 | 5/2004 | Lange et al. |
| 6,748,297 | B2 | 6/2004 | Song et al. |
| 6,756,703 | B2 | 6/2004 | Chang |
| 6,760,647 | B2 | 7/2004 | Nourbakhsh et al. |
| 6,764,373 | B1 | 7/2004 | Osawa et al. |
| 6,769,004 | B2 | 7/2004 | Barrett |
| 6,774,596 | B1 | 8/2004 | Bisset |
| 6,779,380 | B1 | 8/2004 | Nieuwkamp |
| 6,781,338 | B2 | 8/2004 | Jones et al. |
| 6,809,490 | B2 | 10/2004 | Jones et al. |
| 6,810,305 | B2 | 10/2004 | Kirkpatrick |
| 6,830,120 | B1 | 12/2004 | Yashima et al. |
| 6,832,407 | B2 | 12/2004 | Salem et al. |
| 6,836,701 | B2 | 12/2004 | McKee |
| 6,841,963 | B2 | 1/2005 | Song et al. |
| 6,845,297 | B2 | 1/2005 | Allard |
| 6,856,811 | B2 | 2/2005 | Burdue et al. |
| 6,859,010 | B2 | 2/2005 | Jeon et al. |
| 6,859,682 | B2 | 2/2005 | Naka et al. |
| 6,860,206 | B1 | 3/2005 | Rudakevych et al. |
| 6,865,447 | B2 | 3/2005 | Lau et al. |
| 6,870,792 | B2 | 3/2005 | Chiappetta |
| 6,871,115 | B2 | 3/2005 | Huang et al. |
| 6,883,201 | B2 | 4/2005 | Jones et al. |
| 6,886,651 | B1 | 5/2005 | Slocum et al. |
| 6,888,333 | B2 | 5/2005 | Laby |
| 6,901,624 | B2 | 6/2005 | Mori et al. |
| 6,906,702 | B1 | 6/2005 | Tanaka et al. |
| 6,914,403 | B2 | 7/2005 | Tsurumi |
| 6,917,854 | B2 | 7/2005 | Bayer |
| 6,925,357 | B2 | 8/2005 | Wang et al. |
| 6,925,679 | B2 | 8/2005 | Wallach et al. |
| 6,929,548 | B2 | 8/2005 | Wang |
| D510,066 | S | 9/2005 | Hickey et al. |
| 6,938,298 | B2 | 9/2005 | Aasen |
| 6,940,291 | B1 | 9/2005 | Ozick |
| 6,941,199 | B1 | 9/2005 | Bottomley et al. |
| 6,956,348 | B2 | 10/2005 | Landry et al. |
| 6,957,712 | B2 | 10/2005 | Song et al. |
| 6,960,986 | B2 | 11/2005 | Asama et al. |
| 6,965,209 | B2 | 11/2005 | Jones et al. |
| 6,965,211 | B2 | 11/2005 | Tsurumi |
| 6,968,592 | B2 | 11/2005 | Takeuchi et al. |
| 6,971,140 | B2 | 12/2005 | Kim |
| 6,975,246 | B1 | 12/2005 | Trudeau |
| 6,980,229 | B1 | 12/2005 | Ebersole |
| 6,985,556 | B2 | 1/2006 | Shanmugavel et al. |
| 6,993,954 | B1 | 2/2006 | George et al. |
| 6,999,850 | B2 | 2/2006 | McDonald |
| 7,013,527 | B2 | 3/2006 | Thomas et al. |
| 7,024,278 | B2 | 4/2006 | Chiappetta et al. |
| 7,024,280 | B2 | 4/2006 | Parker et al. |
| 7,027,893 | B2 | 4/2006 | Perry et al. |
| 7,030,768 | B2 | 4/2006 | Wanie |
| 7,031,805 | B2 | 4/2006 | Lee et al. |
| 7,032,469 | B2 | 4/2006 | Bailey |
| 7,053,578 | B2 | 5/2006 | Diehl et al. |
| 7,054,716 | B2 | 5/2006 | McKee et al. |
| 7,055,210 | B2 | 6/2006 | Keppler et al. |
| 7,057,120 | B2 | 6/2006 | Ma et al. |
| 7,057,643 | B2 | 6/2006 | Iida et al. |
| 7,065,430 | B2 | 6/2006 | Naka et al. |
| 7,066,291 | B2 | 6/2006 | Martins et al. |
| 7,069,124 | B1 | 6/2006 | Whittaker et al. |
| 7,079,923 | B2 | 7/2006 | Abramson et al. |
| 7,085,623 | B2 | 8/2006 | Siegers |
| 7,085,624 | B2 | 8/2006 | Aldred et al. |
| 7,113,847 | B2 | 9/2006 | Chmura et al. |
| 7,133,746 | B2 | 11/2006 | Abramson et al. |
| 7,142,198 | B2 | 11/2006 | Lee |
| 7,148,458 | B2 | 12/2006 | Schell et al. |
| 7,155,308 | B2 | 12/2006 | Jones |
| 7,167,775 | B2 | 1/2007 | Abramson et al. |
| 7,171,285 | B2 | 1/2007 | Kim et al. |
| 7,173,991 | B2 | 2/2007 | Scarpa |
| 7,174,238 | B1 | 2/2007 | Zweig |
| 7,188,000 | B2 | 3/2007 | Chiappetta et al. |
| 7,193,384 | B1 | 3/2007 | Norman et al. |
| 7,196,487 | B2 | 3/2007 | Jones et al. |
| 7,201,786 | B2 | 4/2007 | Wegelin et al. |
| 7,206,677 | B2 | 4/2007 | Hulden |

(56) References Cited

U.S. PATENT DOCUMENTS 7,211,980 B1 5/2007 Bruemmer et al.
7,225,500 B2 6/2007 Diehl et al.
7,246,405 B2 7/2007 Yan
7,248,951 B2 7/2007 Hulden
7,275,280 B2 10/2007 Haegermarck et al.
7,283,892 B1 10/2007 Boillot et al.
7,288,912 B2 10/2007 Landry et al.
7,318,248 B1 1/2008 Yan
7,320,149 B1 1/2008 Huffman et al.
7,324,870 B2 1/2008 Lee
7,328,196 B2 2/2008 Peters
7,332,890 B2 2/2008 Cohen et al.
7,352,153 B2 4/2008 Yan
7,359,766 B2 4/2008 Jeon et al.
7,360,277 B2 4/2008 Moshenrose et al.
7,363,108 B2 4/2008 Noda et al.
7,388,879 B2 6/2008 Sabe et al.
7,389,166 B2 6/2008 Harwig et al.
7,408,157 B2 8/2008 Yan
7,418,762 B2 9/2008 Arai et al.
7,430,455 B2 9/2008 Casey et al.
7,430,462 B2 9/2008 Chiu et al.
7,441,298 B2 10/2008 Svendsen et al.
7,444,206 B2 10/2008 Abramson et al.
7,448,113 B2 11/2008 Jones et al.
7,459,871 B2 12/2008 Landry et al.
7,467,026 B2 12/2008 Sakagami et al.
7,474,941 B2 1/2009 Kim et al.
7,503,096 B2 3/2009 Lin
7,515,991 B2 4/2009 Egawa et al.
7,555,363 B2 6/2009 Augenbraun et al.
7,557,703 B2 7/2009 Yamada et al.
7,568,259 B2 8/2009 Yan
7,571,511 B2 8/2009 Jones et al.
7,578,020 B2 8/2009 Jaworski et al.
7,600,521 B2 10/2009 Woo
7,603,744 B2 10/2009 Reindle
7,617,557 B2 11/2009 Reindle
7,620,476 B2 11/2009 Morse et al.
7,636,982 B2 12/2009 Jones et al.
7,647,144 B2 1/2010 Haegermarck
7,650,666 B2 1/2010 Jang
7,660,650 B2 2/2010 Kawagoe et al.
7,663,333 B2 2/2010 Jones et al.
7,693,605 B2 4/2010 Park
7,706,917 B1 4/2010 Chiappetta et al.
7,765,635 B2 8/2010 Park
7,801,645 B2 9/2010 Taylor et al.
7,805,220 B2 9/2010 Taylor et al.
7,809,944 B2 10/2010 Kawamoto
7,849,555 B2 12/2010 Hahm et al.
7,853,645 B2 12/2010 Brown et al.
7,920,941 B2 4/2011 Park et al.
7,937,800 B2 5/2011 Yan
7,957,836 B2 6/2011 Myeong et al.
2001/0004719 A1 6/2001 Sommer
2001/0013929 A1 8/2001 Torsten
2001/0020200 A1 9/2001 Das et al.
2001/0022010 A1* 9/2001 Kasper ..... 15/320
2001/0025183 A1 9/2001 Shahidi
2001/0037163 A1 11/2001 Allard
2001/0043509 A1 11/2001 Green et al.
2001/0045883 A1 11/2001 Holdaway et al.
2001/0047231 A1 11/2001 Peless et al.
2001/0047895 A1 12/2001 De et al.
2002/0011367 A1 1/2002 Kolesnik
2002/0011813 A1 1/2002 Koselka et al.
2002/0016649 A1 2/2002 Jones
2002/0021219 A1 2/2002 Edwards
2002/0027652 A1 3/2002 Paromtchik et al.
2002/0036779 A1 3/2002 Kiyoi et al.
2002/0081937 A1 6/2002 Yamada et al.
2002/0095239 A1 7/2002 Wallach et al.
2002/0097400 A1 7/2002 Jung et al.
2002/0104963 A1 8/2002 Mancevski
2002/0108209 A1 8/2002 Peterson
2002/0112742 A1 8/2002 Bredo et al.
2002/0113973 A1 8/2002 Ge
2002/0116089 A1 8/2002 Kirkpatrick
2002/0120364 A1 8/2002 Colens
2002/0124343 A1 9/2002 Reed
2002/0153185 A1 10/2002 Song et al.
2002/0156556 A1 10/2002 Ruffner
2002/0159051 A1 10/2002 Guo
2002/0166193 A1 11/2002 Kasper
2002/0169521 A1 11/2002 Goodman et al.
2002/0173877 A1 11/2002 Zweig
2002/0189871 A1 12/2002 Won
2003/0009259 A1 1/2003 Hattori et al.
2003/0019071 A1 1/2003 Field et al.
2003/0023356 A1 1/2003 Keable
2003/0024986 A1 2/2003 Mazz et al.
2003/0025472 A1 2/2003 Jones et al.
2003/0028286 A1 2/2003 Glenn et al.
2003/0030399 A1 2/2003 Jacobs
2003/0058262 A1 3/2003 Sato et al.
2003/0060928 A1 3/2003 Abramson et al.
2003/0067451 A1 4/2003 Tagg et al.
2003/0097875 A1 5/2003 Lentz et al.
2003/0120389 A1 6/2003 Abramson et al.
2003/0124312 A1 7/2003 Autumn
2003/0126352 A1 7/2003 Barrett
2003/0137268 A1 7/2003 Papanikolopoulos et al.
2003/0146384 A1 8/2003 Logsdon et al.
2003/0192144 A1 10/2003 Song et al.
2003/0193657 A1 10/2003 Uomori et al.
2003/0216834 A1 11/2003 Allard
2003/0221114 A1 11/2003 Nino et al.
2003/0229421 A1 12/2003 Chmura et al.
2003/0229474 A1 12/2003 Suzuki et al.
2003/0233171 A1 12/2003 Heiligensetzer
2003/0233177 A1 12/2003 Johnson et al.
2003/0233870 A1 12/2003 Mancevski
2003/0233930 A1 12/2003 Ozick
2004/0016077 A1 1/2004 Song et al.
2004/0020000 A1 2/2004 Jones
2004/0030448 A1 2/2004 Solomon
2004/0030449 A1 2/2004 Solomon
2004/0030450 A1 2/2004 Solomon
2004/0030451 A1 2/2004 Solomon
2004/0030570 A1 2/2004 Solomon
2004/0030571 A1 2/2004 Solomon
2004/0031113 A1 2/2004 Wosewick et al.
2004/0049877 A1* 3/2004 Jones et al. ..... 15/319
2004/0055163 A1 3/2004 McCambridge et al.
2004/0068351 A1 4/2004 Solomon
2004/0068415 A1 4/2004 Solomon
2004/0068416 A1 4/2004 Solomon
2004/0074038 A1 4/2004 Im et al.
2004/0074044 A1 4/2004 Diehl et al.
2004/0076324 A1 4/2004 Burl et al.
2004/0078924 A1* 4/2004 Roney et al. ..... 15/384
2004/0083570 A1 5/2004 Song et al.
2004/0085037 A1 5/2004 Jones et al.
2004/0088079 A1 5/2004 Lavarec et al.
2004/0093122 A1 5/2004 Galibraith
2004/0098167 A1 5/2004 Yi et al.
2004/0111184 A1 6/2004 Chiappetta et al.
2004/0111821 A1 6/2004 Lenkiewicz et al.
2004/0113777 A1 6/2004 Matsuhira et al.
2004/0117064 A1 6/2004 McDonald
2004/0117846 A1 6/2004 Karaoguz et al.
2004/0118998 A1 6/2004 Wingett et al.
2004/0128028 A1 7/2004 Miyamoto et al.
2004/0133316 A1 7/2004 Dean
2004/0134336 A1 7/2004 Solomon
2004/0134337 A1 7/2004 Solomon
2004/0143919 A1 7/2004 Wilder
2004/0148419 A1 7/2004 Chen et al.
2004/0148731 A1 8/2004 Damman et al.
2004/0153212 A1 8/2004 Profio et al.
2004/0156541 A1 8/2004 Jeon et al.
2004/0158357 A1 8/2004 Lee et al.
2004/0181706 A1 9/2004 Chen et al.

(56) References Cited

U.S. PATENT DOCUMENTS

2004/0187249 A1 9/2004 Jones et al.
2004/0187457 A1 9/2004 Colens
2004/0196451 A1 10/2004 Aoyama
2004/0200505 A1 10/2004 Taylor et al.
2004/0204792 A1 10/2004 Taylor et al.
2004/0210345 A1 10/2004 Noda et al.
2004/0210347 A1 10/2004 Sawada et al.
2004/0211444 A1 10/2004 Taylor et al.
2004/0221790 A1 11/2004 Sinclair et al.
2004/0236468 A1 11/2004 Taylor et al.
2004/0244138 A1 12/2004 Taylor et al.
2004/0255425 A1 12/2004 Arai et al.
2005/0000543 A1 1/2005 Taylor et al.
2005/0010330 A1 1/2005 Abramson et al.
2005/0010331 A1 1/2005 Taylor et al.
2005/0021181 A1 1/2005 Kim et al.
2005/0067994 A1 3/2005 Jones et al.
2005/0085947 A1 4/2005 Aldred et al.
2005/0137749 A1 6/2005 Jeon et al.
2005/0138765 A1* 6/2005 Lee ..... 15/392
2005/0144751 A1 7/2005 Kegg et al.
2005/0150074 A1 7/2005 Diehl et al.
2005/0150519 A1 7/2005 Keppler et al.
2005/0154795 A1 7/2005 Kuz et al.
2005/0156562 A1 7/2005 Cohen et al.
2005/0165508 A1 7/2005 Kanda et al.
2005/0166354 A1 8/2005 Uehigashi
2005/0166355 A1 8/2005 Tani
2005/0172445 A1 8/2005 Diehl et al.
2005/0183229 A1 8/2005 Uehigashi
2005/0183230 A1 8/2005 Uehigashi
2005/0187678 A1 8/2005 Myeong et al.
2005/0192707 A1 9/2005 Park et al.
2005/0204717 A1 9/2005 Colens
2005/0209736 A1 9/2005 Kawagoe
2005/0211880 A1 9/2005 Schell et al.
2005/0212929 A1 9/2005 Schell et al.
2005/0213082 A1 9/2005 DiBernardo et al.
2005/0213109 A1 9/2005 Schell et al.
2005/0217042 A1 10/2005 Reindle
2005/0218852 A1 10/2005 Landry et al.
2005/0222933 A1 10/2005 Wesby
2005/0229340 A1 10/2005 Sawalski et al.
2005/0229355 A1 10/2005 Crouch et al.
2005/0235451 A1 10/2005 Yan
2005/0251292 A1 11/2005 Casey et al.
2005/0255425 A1 11/2005 Pierson
2005/0258154 A1 11/2005 Blankenship et al.
2005/0273967 A1 12/2005 Taylor et al.
2005/0288819 A1 12/2005 de Guzman
2006/0000050 A1 1/2006 Cipolla et al.
2006/0010638 A1 1/2006 Shimizu et al.
2006/0020369 A1 1/2006 Taylor et al.
2006/0020370 A1 1/2006 Abramson
2006/0021168 A1 2/2006 Nishikawa
2006/0025134 A1 2/2006 Cho et al.
2006/0037170 A1 2/2006 Shimizu
2006/0042042 A1* 3/2006 Mertes et al. ..... 15/392
2006/0044546 A1 3/2006 Lewin et al.
2006/0060216 A1 3/2006 Woo
2006/0061657 A1 3/2006 Rew et al.
2006/0064828 A1 3/2006 Stein et al.
2006/0087273 A1 4/2006 Ko et al.
2006/0089765 A1 4/2006 Pack et al.
2006/0100741 A1 5/2006 Jung
2006/0119839 A1 6/2006 Bertin et al.
2006/0143295 A1 6/2006 Costa et al.
2006/0146776 A1 7/2006 Kim
2006/0190133 A1 8/2006 Konandreas et al.
2006/0190146 A1 8/2006 Morse et al.
2006/0196003 A1 9/2006 Song et al.
2006/0220900 A1 10/2006 Ceskutti et al.
2006/0259194 A1 11/2006 Chiu
2006/0259494 A1 11/2006 Watson et al.
2006/0288519 A1 12/2006 Jaworski et al.
2006/0293787 A1 12/2006 Kanda et al.
2007/0006404 A1 1/2007 Cheng et al.
2007/0017061 A1 1/2007 Yan
2007/0028574 A1 2/2007 Yan
2007/0032904 A1 2/2007 Kawagoe et al.
2007/0042716 A1 2/2007 Goodall et al.
2007/0043459 A1 2/2007 Abbott et al.
2007/0061041 A1 3/2007 Zweig
2007/0114975 A1 5/2007 Cohen et al.
2007/0150096 A1 6/2007 Yeh et al.
2007/0157415 A1 7/2007 Lee et al.
2007/0157420 A1 7/2007 Lee et al.
2007/0179670 A1 8/2007 Chiappetta et al.
2007/0226949 A1 10/2007 Hahm et al.
2007/0234492 A1 10/2007 Svendsen et al.
2007/0244610 A1 10/2007 Ozick et al.
2007/0250212 A1 10/2007 Halloran et al.
2007/0266508 A1 11/2007 Jones et al.
2008/0007203 A1 1/2008 Cohen et al.
2008/0039974 A1 2/2008 Sandin et al.
2008/0052846 A1 3/2008 Kapoor et al.
2008/0091304 A1 4/2008 Ozick et al.
2008/0184518 A1 8/2008 Taylor
2008/0276407 A1 11/2008 Schnittman et al.
2008/0281470 A1 11/2008 Gilbert et al.
2008/0282494 A1 11/2008 Won et al.
2008/0294288 A1 11/2008 Yamauchi
2008/0302586 A1 12/2008 Yan
2008/0307590 A1 12/2008 Jones et al.
2009/0007366 A1 1/2009 Svendsen et al.
2009/0038089 A1 2/2009 Landry et al.
2009/0049640 A1 2/2009 Lee et al.
2009/0055022 A1 2/2009 Casey et al.
2009/0102296 A1 4/2009 Greene et al.
2009/0169146 A1* 7/2009 Gagnon ..... 384/462
2009/0292393 A1 11/2009 Casey et al.
2010/0011529 A1 1/2010 Won et al.
2010/0049365 A1 2/2010 Jones et al.
2010/0063628 A1 3/2010 Landry et al.
2010/0107355 A1 5/2010 Won et al.
2010/0257690 A1 10/2010 Jones et al.
2010/0257691 A1 10/2010 Jones et al.
2010/0263158 A1 10/2010 Jones et al.
2010/0268384 A1 10/2010 Jones et al.
2010/0312429 A1 12/2010 Jones et al.

FOREIGN PATENT DOCUMENTS

DE 3317376 A1 11/1984
DE 3536907 A1 4/1986
DE 3404202 A1 5/1987
DE 4338841 A1 5/1995
DE 4414683 A1 10/1995
DE 19849978 A1 5/2000
DE 10242257 A1 4/2003
DE 102004038074 B3 6/2005
DE 10357636 A1 7/2005
DE 102004041021 B3 8/2005
DE 102005046813 A1 4/2007
EP 294101 A2 12/1988
EP 358628 A2 3/1990
EP 433697 A2 6/1991
EP 437024 A1 7/1991
EP 479273 A2 4/1992
EP 554978 A2 8/1993
EP 615719 A1 9/1994
EP 792726 A1 9/1997
EP 845237 A1 6/1998
EP 861629 A1 9/1998
EP 930040 A2 7/1999
EP 1018315 A1 7/2000
EP 1172719 A1 1/2002
EP 1228734 A2 8/2002
EP 1331537 A1 7/2003
EP 1380245 A1 1/2004
EP 1380246 A2 1/2004
EP 1553472 A1 7/2005
EP 1557730 A1 7/2005
EP 1642522 A2 4/2006

(56) References Cited

FOREIGN PATENT DOCUMENTS

| | | | |
|---|---|---|---|
| ES | 2238196 | A1 | 8/2005 |
| FR | 2601443 | A1 | 1/1988 |
| FR | 2828589 | A1 | 2/2003 |
| GB | 702426 | A | 1/1954 |
| GB | 2128842 | A | 5/1984 |
| GB | 2213047 | A | 8/1989 |
| GB | 2225221 | A | 5/1990 |
| GB | 2267360 | A | 12/1993 |
| GB | 2283838 | A | 5/1995 |
| GB | 2284957 | A | 6/1995 |
| GB | 2300082 | A | 10/1996 |
| GB | 2404330 | A | 2/2005 |
| GB | 2417354 | A | 2/2006 |
| JP | 53110257 | | 9/1978 |
| JP | 57014726 | | 1/1982 |
| JP | 59033511 | | 3/1984 |
| JP | 2283343 | | 11/1984 |
| JP | 60089213 | | 5/1985 |
| JP | 61023221 | | 1/1986 |
| JP | 63158032 | | 7/1988 |
| JP | 63241610 | A | 10/1988 |
| JP | 03-051023 | | 3/1991 |
| JP | 554620 | | 7/1993 |
| JP | 06-038912 | | 2/1994 |
| JP | 7059702 | | 3/1995 |
| JP | 7129239 | | 5/1995 |
| JP | 7281742 | | 10/1995 |
| JP | 7-295636 | | 11/1995 |
| JP | 7311041 | | 11/1995 |
| JP | 8000393 | | 1/1996 |
| JP | 8016241 | | 1/1996 |
| JP | 8016776 | | 2/1996 |
| JP | 8063229 | | 3/1996 |
| JP | 8083125 | | 3/1996 |
| JP | 08-089451 | | 4/1996 |
| JP | 08-152916 | | 6/1996 |
| JP | 2520732 | B2 | 7/1996 |
| JP | 8256960 | | 10/1996 |
| JP | 8286741 | | 11/1996 |
| JP | 8286744 | | 11/1996 |
| JP | 8322774 | | 12/1996 |
| JP | 9160644 | | 6/1997 |
| JP | 9-179625 | | 7/1997 |
| JP | 9179685 | | 7/1997 |
| JP | 9185410 | A | 7/1997 |
| JP | 9192069 | | 7/1997 |
| JP | 9204223 | | 8/1997 |
| JP | 9206258 | | 8/1997 |
| JP | 09251318 | | 9/1997 |
| JP | 9319431 | | 12/1997 |
| JP | 10314088 | | 2/1998 |
| JP | 10117973 | | 5/1998 |
| JP | 10177414 | | 6/1998 |
| JP | 10228316 | | 8/1998 |
| JP | 10240342 | | 9/1998 |
| JP | 10260727 | | 9/1998 |
| JP | 11065655 | | 3/1999 |
| JP | 11085269 | | 3/1999 |
| JP | 11102219 | | 4/1999 |
| JP | 11212642 | | 8/1999 |
| JP | 11346964 | | 12/1999 |
| JP | 2000056006 | A | 2/2000 |
| JP | 10240343 | | 5/2000 |
| JP | 2000353014 | A | 12/2000 |
| JP | 2001087182 | A | 4/2001 |
| JP | 2001525567 | A | 12/2001 |
| JP | 2002-323925 | A | 11/2002 |
| JP | 2002360471 | A | 12/2002 |
| JP | 2002360482 | A | 12/2002 |
| JP | 2002369778 | A | 12/2002 |
| JP | 200310076 | | 1/2003 |
| JP | 2003-5296 | | 2/2003 |
| JP | 2003-036116 | | 2/2003 |
| JP | 2003-38402 | | 2/2003 |
| JP | 2003-505127 | | 2/2003 |
| JP | 03375843 | B2 | 2/2003 |
| JP | 200338401 | | 2/2003 |
| JP | 2003061882 | A | 3/2003 |
| JP | 2003167628 | A | 6/2003 |
| JP | 2003180586 | A | 7/2003 |
| JP | 2003180587 | A | 7/2003 |
| JP | 2003190064 | A | 7/2003 |
| JP | 2003262520 | A | 9/2003 |
| JP | 2003304992 | A | 10/2003 |
| JP | 2003310489 | A | 11/2003 |
| JP | 2003310509 | A | 11/2003 |
| JP | 2004123040 | A | 4/2004 |
| JP | 2004148021 | A | 5/2004 |
| JP | 2004160102 | A | 6/2004 |
| JP | 2004166968 | A | 6/2004 |
| JP | 2004174228 | A | 6/2004 |
| JP | 2005118354 | A | 5/2005 |
| JP | 2005135400 | A | 5/2005 |
| JP | 2005224265 | A | 8/2005 |
| JP | 2005230032 | A | 9/2005 |
| JP | 2005245916 | A | 9/2005 |
| JP | 2005346700 | A | 12/2005 |
| JP | 2005352707 | A | 12/2005 |
| JP | 2006043071 | A | 2/2006 |
| JP | 2006155274 | A | 6/2006 |
| JP | 2006164223 | A | 6/2006 |
| JP | 2006247467 | A | 9/2006 |
| JP | 2006260161 | A | 9/2006 |
| JP | 2007034866 | A | 2/2007 |
| JP | 2009015611 | A | 1/2009 |
| JP | 2010198552 | A | 9/2010 |
| JP | 1150428 | | 3/2011 |
| JP | 2011050428 | A | 3/2011 |
| JP | 5091604 | B2 | 12/2012 |
| WO | WO-9526512 | A1 | 10/1995 |
| WO | WO-9530887 | A1 | 11/1995 |
| WO | WO-9617258 | A2 | 6/1996 |
| WO | WO-9715224 | A1 | 5/1997 |
| WO | WO-9740734 | A1 | 11/1997 |
| WO | WO-9741451 | A1 | 11/1997 |
| WO | WO-9853456 | A1 | 11/1998 |
| WO | WO-9905580 | A2 | 2/1999 |
| WO | WO-9928800 | A1 | 6/1999 |
| WO | WO-9938056 | A1 | 7/1999 |
| WO | WO-9938237 | A1 | 7/1999 |
| WO | WO-9943250 | A1 | 9/1999 |
| WO | WO-000443 | A1 | 1/2000 |
| WO | WO-0036962 | A1 | 6/2000 |
| WO | WO-0038026 | A1 | 6/2000 |
| WO | WO-0038028 | A1 | 6/2000 |
| WO | WO-0038029 | A1 | 6/2000 |
| WO | WO-0078410 | A1 | 12/2000 |
| WO | WO-0106904 | A1 | 2/2001 |
| WO | WO-0106905 | A1 | 2/2001 |
| WO | WO-0180703 | A1 | 11/2001 |
| WO | WO-0191623 | A2 | 12/2001 |
| WO | WO-02/39864 | A1 | 5/2002 |
| WO | WO-02/39868 | A1 | 5/2002 |
| WO | WO-02067752 | A1 | 9/2002 |
| WO | WO-02069774 | A1 | 9/2002 |
| WO | WO-02069775 | A2 | 9/2002 |
| WO | WO-02071175 | A1 | 9/2002 |
| WO | WO-02075350 | A1 | 9/2002 |
| WO | WO-02081074 | A1 | 10/2002 |
| WO | WO-02101477 | A2 | 12/2002 |
| WO | WO-03015220 | A1 | 2/2003 |
| WO | WO-03024292 | A2 | 3/2003 |
| WO | WO-03026474 | A2 | 4/2003 |
| WO | WO-03040546 | A1 | 5/2003 |
| WO | WO-03040845 | A1 | 5/2003 |
| WO | WO-03040846 | A1 | 5/2003 |
| WO | WO-03062850 | A2 | 7/2003 |
| WO | WO-2004004533 | A1 | 1/2004 |
| WO | WO-2004004534 | A1 | 1/2004 |
| WO | WO-2004005956 | A1 | 1/2004 |
| WO | WO-2004006034 | A2 | 1/2004 |
| WO | WO-2004025947 | A2 | 3/2004 |
| WO | WO-2004058028 | A2 | 7/2004 |
| WO | WO-2004059409 | A1 | 7/2004 |

(56) References Cited

FOREIGN PATENT DOCUMENTS

| | | | |
|---|---|---|---|
| WO | WO-2005006935 | A1 | 1/2005 |
| WO | WO-2005055795 | A1 | 6/2005 |
| WO | WO-2005055796 | A2 | 6/2005 |
| WO | WO-2005077243 | A1 | 8/2005 |
| WO | WO-2005077244 | A1 | 8/2005 |
| WO | WO-2005081074 | A1 | 9/2005 |
| WO | WO-2005082223 | A1 | 9/2005 |
| WO | WO-2005083541 | A1 | 9/2005 |
| WO | WO-2005098475 | A1 | 10/2005 |
| WO | WO-2005098476 | A1 | 10/2005 |
| WO | WO-2006061133 | A1 | 6/2006 |
| WO | WO-2006068403 | A1 | 6/2006 |
| WO | WO-2007065033 | A2 | 6/2007 |
| WO | WO-2007137234 | A2 | 11/2007 |

OTHER PUBLICATIONS

Pressler et al., "A Short History of Cleaning Robots," Autonomous Robots, vol. 9, pp. 211-226 (2000).

* cited by examiner

VACUUM BRUSH

CROSS-REFERENCE TO RELATED APPLICATIONS

This application claims the benefit of U.S. Provisional Application No. 61/304,886, filed Feb. 16, 2010, the disclosure of which is hereby incorporated by reference in its entirety.

FIELD

The present teachings relate to a vacuum brush for a robotic vacuum. The present teachings relate more particularly to a vacuum brush for a robotic vacuum including portions that lessen the amount of hair and similar matter that reach the bearing and drive areas of the robotic vacuum cleaning head.

BACKGROUND

Hair and other similar matter can become wrapped around the ends of robotic vacuum brushes, becoming entangled in the ends of the brushes (e.g., around bearings and drive protrusions) and/or in gearboxes that drive the brushes to rotate relative to the cleanings head compartment. Such entanglement can stall the robotic vacuum, make cleaning less effective, or cause other undesirable events.

Axle guards or end caps can be provided adjacent one or more ends of each brush to keep hair and other similar matter from reaching the brush ends to prevent such matter from becoming entangled in the ends of the brushes and/or in the gearbox. However, the axle guards and end caps currently employed in robotic vacuums may not sufficiently prevent hair and similar matter from becoming entangled in the ends of the brushes and/or in the gearbox. Thus, robotic vacuums employing known axle guards and end caps may still stall due to entangled matter.

SUMMARY

The present teachings provide a rotating cleaning element configured to be inserted in a cleaning head compartment of a robotic vacuum. The rotating cleaning element includes a drive end including a drive protrusion configured to engage a drive mechanism of the cleaning head compartment, a bearing end and a shroud configured to surround at least a portion of the bearing end to lessen an amount of hair and similar matter that reaches the bearing, and a central member extending between the bearing end and the drive end.

The bearing end of the rotating cleaning element may further include a cylindrical sleeve surrounding a shaft of the rotating cleaning element, a circular flange adjacent the central member of the rotating cleaning element and extending radially outwardly from the sleeve of the central member, and a recess between a portion of the central member and the circular flange.

The shroud may include a first wall generally parallel to a central axis of the central member, a second wall extending generally perpendicular to the first wall, a third wall extending generally perpendicular to the second wall, and a fourth wall extending generally perpendicular to the third wall to define the interior of the shroud, and wherein a reservoir into which the hair and similar matter is collected is defined between the circular flange, the first wall of the shroud, the second wall of the shroud, and the sleeve.

The rotating cleaning element further includes a labyrinth passage between the recess and the reservoir, the labyrinth passage being a path between the recess and the reservoir at an outer diameter of the circular flange.

The rotating cleaning element may further include a guard extending outwardly from the sleeve to an interior wall of the shroud.

The circular flange, the guard and the shroud may define a first reservoir into which the hair and similar matter is collected.

The shroud may include a first wall generally parallel to a central axis of the central member, a second wall extending generally perpendicular to the first wall, a third wall extending generally perpendicular to the second wall, and a fourth wall extending generally perpendicular to the third wall to define the interior of the shroud.

The at least one guard may extend from the sleeve radially outwardly to the third wall of the shroud, the first reservoir being defined between the circular flange, the first wall of the shroud, the second wall of the shroud, a portion of the third wall of the shroud, the guard, and the sleeve.

The guard may extend from the sleeve radially outwardly toward the third wall of the shroud, the first reservoir being defined between the circular flange, the first wall of the shroud, the second wall of the shroud, the guard, and the sleeve.

The rotating cleaning element may further include a first labyrinth passage between the recess and the first reservoir, the first labyrinth passage being a path between the recess and the first reservoir at an outer diameter of the circular flange.

The guard, the sleeve and the shroud may define a second reservoir into which the hair and similar matter is collected.

The rotating cleaning element may further include a second labyrinth passage between the first reservoir and the second reservoir, the second labyrinth passage being a path between the first reservoir and the second reservoir at an outer diameter of the guard.

The rotating cleaning element may be one of a main brush and a flapper brush.

The present teachings provide a cleaning head subsystem for a robotic vacuum, the cleaning head subsystem including a cleaning head compartment and at least one cleaning element. The cleaning element includes a bearing end and a first shroud configured to surround at least a portion of the bearing end and a sleeve thereof, a first reservoir being defined at least between a portion of the first shroud and the sleeve, a drive end comprising a drive protrusion configured to engage a drive mechanism of the cleaning head compartment, and a central member extending between the bearing end and the drive end. The drive end includes a second shroud configured to surround at least a portion of the drive end of the brush assembly and at least one guard extending radially outwardly from a central axis of the central member toward an interior of the second shroud, a second reservoir being defined at least between a portion of the second shroud and the guard.

The drive end may further include a retention device and a drive protrusion, the retention device being configured to limit axial motion of the cleaning element.

The retention device may include a plurality of interlocking members configured to engage one or more recesses in a drive gear that engages the drive protrusion.

The present teachings provide a cleaning head subsystem for a robotic vacuum, the cleaning head subsystem including a cleaning head compartment, a cleaning element assembly disposed within the cleaning head compartment, the cleaning element assembly including a main brush and a flapper brush, and a gearbox comprising a main brush drive gear to drive the main brush, a flapper brush drive gear to drive the flapper brush, and a first shroud configured to surround at least one of the main brush drive gear and the flapper brush drive gear.

The cleaning head subsystem may further include a second shroud configured to surround the other of the main brush drive gear and the flapper brush drive gear.

The first shroud may be disposed over a drive end of the main brush in an installed position of the main brush, and the second shroud may be disposed over a drive end of the flapper brush in an installed position of the flapper brush.

The cleaning head subsystem may further include a motor to drive the gearbox, and a third shroud extending between the motor and the gearbox.

The third shroud may cooperate with the gearbox housing to create a recessed collection area for hair and similar matter.

Additional objects and advantages of the present teachings will be set forth in part in the description which follows, and in part will be obvious from the description, or may be learned by practice of the present teachings. The objects and advantages of the teachings will be realized and attained by means of the elements and combinations particularly pointed out in the appended claims.

It is to be understood that both the foregoing general description and the following detailed description are exemplary and explanatory only and are not restrictive of the present teachings, as claimed.

The accompanying drawings, which are incorporated in and constitute a part of this specification, illustrate embodiments of the present teachings and, together with the description, serve to explain the principles of the teachings.

DESCRIPTION OF THE EMBODIMENTS

Reference will now be made in detail to embodiments of the present teachings, examples of which are illustrated in the accompanying drawings.

Some robotic vacuums include a cleaning head subsystem providing cleaning mechanisms for the robotic vacuum and comprising a brush assembly including a main brush and a flapper brush as illustrated in U.S. Pat. No. 7,636,982, the disclosure of which is incorporated by reference herein in its entirety. The main brush and the flapper brush can be mounted in recesses in the cleaning head compartment. Each main brush and flapper brush can comprise a central member (e.g., a cage) with first and second ends configured to mount the brush in the cleaning head compartment. One end of the brush/flapper is mounted to a gearbox or drive side of the cleaning head compartment, and the other end of the brush/flapper can comprise a bearing allowing the brush to rotate substantially freely when mounted to an opposite end of the cleaning head.

Axle guards or end caps can be provided adjacent one or more ends of each brush to lessen the amount of hair and similar matter that reaches and becomes entangled in the ends of the brushes and/or in the gearbox. Entanglement can stall the robotic vacuum, make cleaning less effective, or cause other undesirable events.

The present teachings therefore include a number of improvements for the ends of the main brush and/or the flapper brush that lessen the amount of hair and similar matter that reach and become entangled in the ends of the brushes and/or in the gearbox.

Figure 1:
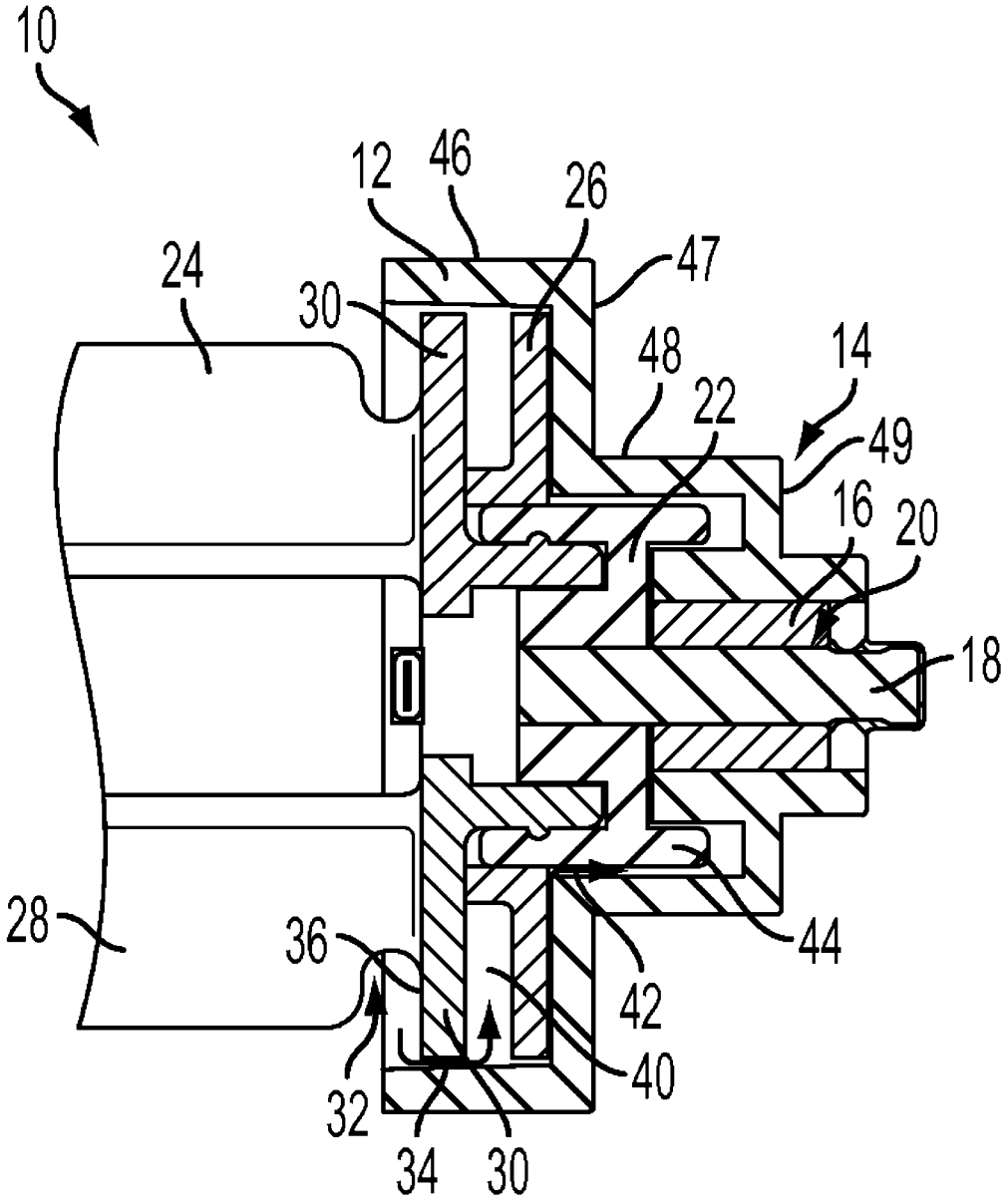
FIGS. 1-4 are cross-sectional views of various embodiments of a bearing end portion of a main brush for a robotic vacuum in accordance with the present teachings.

FIG. 1 illustrates a brush that may be a main brush or a flapper brush of a cleaning head subsystem, for example, that includes an embodiment of a shroud that can be employed in accordance with the present teachings to cover at least the bearing end of one or more of the main brush and the flapper brush of the cleaning head subsystem. In FIG. 1, the shroud 12 is shown covering a bearing end 14 of a brush 10, which is shown in FIG. 1 as a main brush. The shroud 12 is preferably not attached to the brush 10 and thus can remain stationary while the brush 10 rotates. The illustrated shroud 12 covers the bearing end 14 of the illustrated brush 10, and can optionally include an integrally molded or formed bearing 16 to reduce the total number of parts in the cleaning head subsystem. The bearing 16 need not, however, be integrally molded or formed in the shroud 12 and may be provided as a separate piece that, for example, fits within the shroud 12. The bearing 16 allows a shaft 18 of the brush 10 to rotate substantially freely when mounted in the cleaning head (shown more clearly in FIG. 15A, for example). If an integrally molded or formed bearing 16 is used with the shroud 12, an axle (or shaft 18) of the brush 10 is inserted into an aperture 20 in the shroud/bearing. When the bearing 16 is provided separate from the shroud 12, the brush shaft 18 can be inserted in the bearing 16 and then the bearing 16 can be inserted in the shroud 12, or the bearing 16 can be inserted in the shroud 12 before the shaft 18 is inserted into the bearing 16.

A shaft housing/cage cap 22 can be used to attach the shaft 18 to a cage 24 of the brush 10. The shaft housing/cage cap 22 provides protection for the bearing 16 from hair and other matter migrating into bearing 16. The shroud 12 includes a first wall 46 parallel to the cage 24 of the brush 10, a second wall 47 extending relatively perpendicularly from the first wall 46 toward the shaft 18, a third wall 48 extending relatively perpendicularly from the second wall 47 toward the bearing end 14, and a fourth wall 49 extending relatively perpendicularly from the third wall 48. A guard (e.g., an axle guard) 26 can surround the shaft housing/cage cap 22 to prevent hair and similar matter that has entered an interior of the shroud 12 from migrating outwardly toward the shaft housing/cage cap 22, the bearing 16, and the shaft 18. The guard 26 can extend perpendicularly with respect to the shaft 18 toward the first wall 46 of the shroud 12 and an outer face of the guard 26 can be maintained in close proximity to the second wall 47 to prevent hair and other matter from approaching the bearing 16.

FIG. 1 includes a circular flange 30, which may be similar to the guard 26 but spaced therefrom, a recess 32 lying between ribs 28 of the cage 24 and the circular flange 30, and a first labyrinth passage 34 from the recess 32, through a space between the outer diameter of the circular flange 30 and the shroud 12 to an internal reservoir 40 formed between the circular flange 30, the guard 26, and the first wall 46 of the shroud 12. The circular flange 30 is substantially parallel to the guard 26 and also extends perpendicularly with respect to the shaft 18 toward the first wall 46 of the shroud 12. Hair may collect around the cage ribs 28 and gather in the recess 32. Build-up of hair in the recess 32 and against a facing wall 36 of the circular flange 30 can provide a dam that prevents entry of hair and similar matter into the shroud interior once initial buildup has occurred, providing a location for hair and similar matter to collect where the hair and similar matter will not stall the robotic vacuum. The first labyrinth passage 34 provides a short passage from the recess 32 at a large outer diameter of the circular flange 30 to the reservoir 40. The short length of the first labyrinth passage 34 ensures that minimal torque is required if any hair or similar matter enters the shroud 12. In particular, if the labyrinth passage 34 was long, hair and other matter would be more likely to get stuck, causing a rise in torque and resulting in stalling the cleaning head. The internal reservoir 40 formed between the circular flange 30, the guard 26 and the first wall 46 of the shroud 12 provides a location for hair and similar matter that has entered the shroud 12 to collect where the hair and similar matter will not stall the robotic vacuum, i.e., the hair and other matter does not interfere with the bearing 16 when the hair, etc. is retained within the internal reservoir 40.

A second labyrinth passage 42 is formed between an exterior surface of the shaft housing/cage cap 22 and a complementary interior surface of the shroud 22 between the shaft housing/cage cap 22 and the second wall 47, the third wall 48 and the fourth wall 49 of the shroud, particularly around protrusions 44 of the shaft housing/cage cap 22 that extend into recesses in the shroud 12 interior. The path through the second labyrinth passage 42 is long and offers additional protection for the bearing 16 because the first labyrinth passage 34 has drastically reduced the amount of hair reaching the second labyrinth passage 42.

Figure 2:
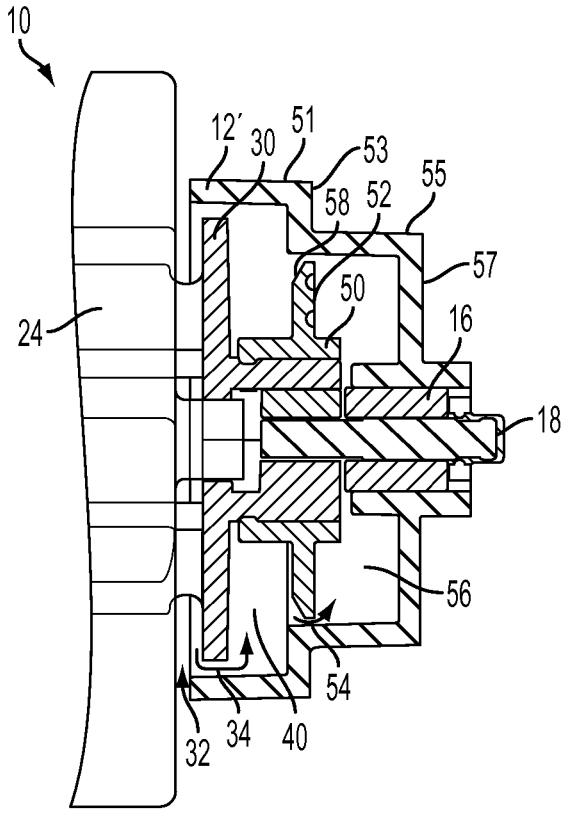

FIG. 2 illustrates another embodiment of a bearing end portion of a main brush for a robotic vacuum, wherein like reference numbers indicate like features. The brush 10 includes a shroud 12' and a circular flange 30 that is integrally formed with the brush cage 24. A recess 32 is provided between ribs of the brush cage 24 and the circular flange 30 in order to collect hair and other matter and provides a dam that prevents entry of the hair and other matter into the interior of the shroud 12'. The brush 10 also includes a sleeve 50 generally surrounding a shaft 18 of the brush 10 with a guard 52 extending perpendicularly from the sleeve 50 toward a wall of the shroud 12'. An end 58 of the guard 52 may be slightly tapered toward its distal end on the side opposite the bearing end 14 of the brush 10. Such tapering can be used to accommodate manufacturing tolerances.

The shroud 12' includes a first wall 51 extending generally parallel with a shaft 18 that holds a bearing 16, a second wall 53 that extends generally perpendicular to the first wall 51, a third wall 55 extending from the second wall 53 toward the bearing end 14 and a fourth wall 57 extending generally perpendicular to the third wall 55 toward the bearing 16. The guard 52 extends perpendicularly away from the shaft 18 and can be roughly aligned with the second wall 53, and can divide the interior space of the shroud 12' into a first reservoir 40 and a second reservoir 56. Similar to FIG. 1, a first labyrinth passage 34 is provided from the recess 32 to the first reservoir 40 at the outer diameter of the circular flange 30. The short length of the first labyrinth 34 ensures that minimal torque is required by minimizing the likelihood of hair and other matter getting stuck, as discussed above, should hair or other matter migrate into the gaps.

The second reservoir 56 is defined between the guard 52, the third wall 55 of the shroud 12', the first wall 57 of the shroud 12' and the bearing 16. The second reservoir provides an additional location to collect hair and other matter. The space of the reservoirs 40 and 56 allows hair to be kept loosely, which provides a web to tangle additional hair as the hair enters the reservoirs 40 and 56. A second labyrinth passage 54 is provided from the first reservoir 40 to the second reservoir 56 in a space between the end 58 of the guard 52 and wall 55. The second labyrinth passage 54 provides a short passage at a larger outer diameter to minimize the amount of hair and other matter that is able to enter further into the shroud 12' toward the bearing 16.

Figure 3:
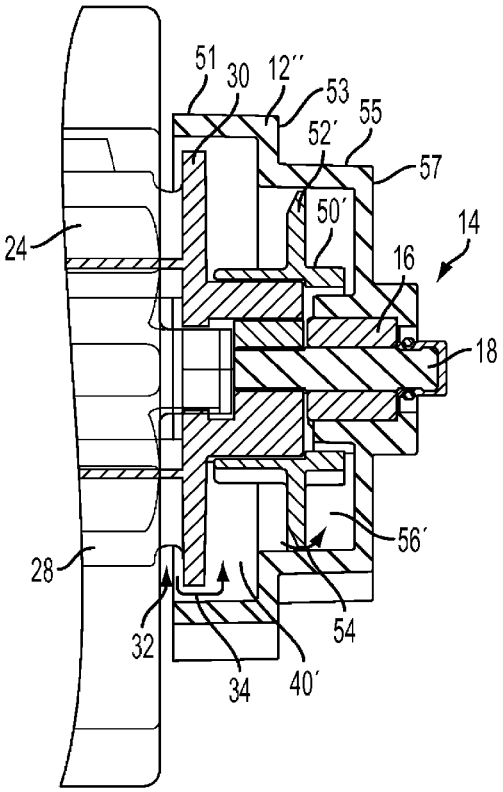

FIG. 3 illustrates another embodiment of a bearing end portion of a main brush for a robotic vacuum, wherein like reference numbers indicate like features. In FIG. 3, a circular flange 30 is provided and a recess 32 is defined between the circular flange 30 and the ribs 28 of the cage 24. The shroud 12" is similar to the shroud 12' illustrated in FIG. 2, with the first 51 and third 53 walls being relatively shorter. Thus, the shroud 12" of FIG. 3 is smaller than the shroud 12' of FIG. 2.

In the embodiment of FIG. 3, the sleeve 50' extends further toward the bearing end 14 than the sleeve 50 in FIG. 2. The guard 52', which extends perpendicularly from the sleeve 50', is provided and extends to the third wall 55, thus providing a larger first reservoir 40' and a smaller second reservoir 56', allowing more hair and other matter to collect in the first reservoir 40' after passing from the recess 32 through the first labyrinth passage 34. The first reservoir 40' is defined between the circular flange 30, the first wall 51, the second wall 53, a portion of the third wall 55, the guard 52' and the sleeve 50'. The second reservoir 56' is defined between the third wall 55 and the fourth wall 57 of the shroud 12" and is smaller than the first reservoir 40'. The embodiment of FIG. 3 may provide better performance than the embodiment of FIG. 2 in preventing hair from reaching the bearing 16.

Figure 4:
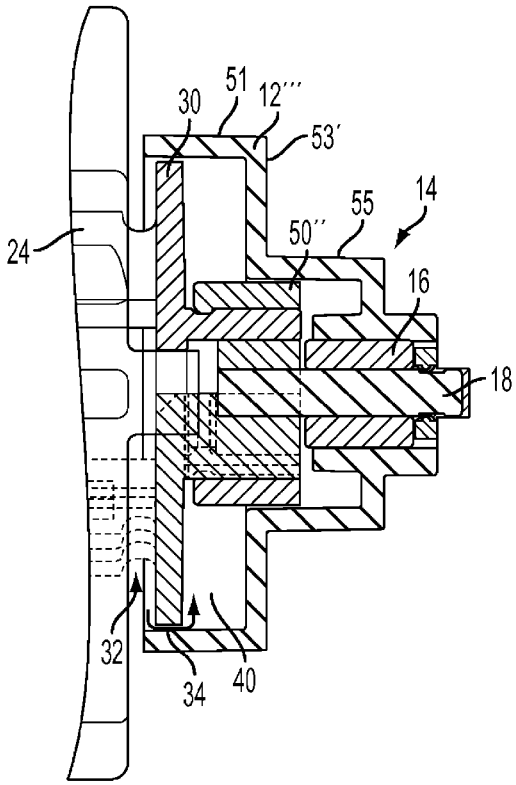

FIG. 4 illustrates another embodiment of a bearing end portion of a main brush for a robotic vacuum, wherein like reference numbers indicate like features. In FIG. 4, a circular flange 30 is provided and a recess 32 is defined between the circular flange 30 and the ribs 28 of the cage 24. The shroud 12''' is similar to the shroud 12' illustrated in FIG. 2 and the shroud 12" illustrated in FIG. 3, with the second wall 53 being relatively longer than the second walls of the shroud 12' and the shroud 12".

In the embodiment of FIG. 4, a sleeve 50" extends toward the bearing end 14. The sleeve 50" does not include a guard. The second wall 53' extends from the first wall 51 to the sleeve 50". A first reservoir 40 is defined between the circular flange 30, the first wall 51, the second wall 53' that extends to the sleeve 50" and the sleeve 50". The first reservoir 40 is similarly sized to that of the first reservoir 40 shown in FIG. 2. A first labyrinth passage 34 provides a path for the hair and other matter that is received in the recess 32 to travel to the first reservoir 40. Due to the configuration of the sleeve 50" without a guard and the configuration of the shroud 12''', only one main reservoir is provided to accumulate hair and other matter and prevent the hair and other matter from being received into the bearing 16. Thus, the embodiment of FIG. 4 may provide worse performance than the embodiments of FIGS. 2 and 3 of preventing hair from reaching the bearing 16. The benefits of using the embodiment of FIG. 4 will be discussed below in reference to FIG. 7.

Figure 5:
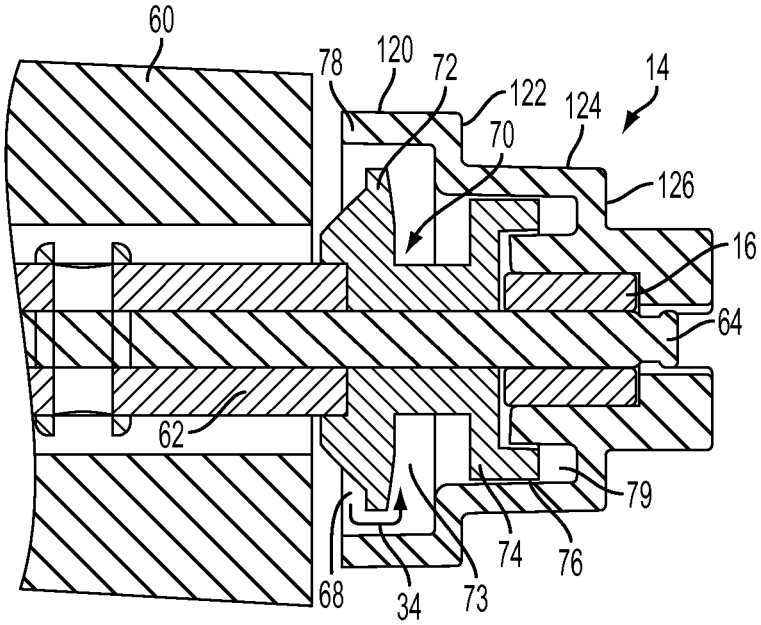
FIGS. 5 and 6 are cross-sectional views of various embodiments of a bearing end portion of a flapper brush for a robotic vacuum in accordance with the present teachings.

FIG. 5 illustrates another embodiment of a shroud that can be employed in accordance with the present teachings to cover at least the bearing end of one or more of the main brush and the flapper brush of a cleaning head subsystem. In FIG. 5 a shroud 78 is shown covering a bearing end 14 of a flapper brush 60. The flapper brush 60 includes a flapper shaft 62, for example with an overmold. The shroud 78 is preferably not attached to the brush 60 and thus can remain stationary while the brush 60 rotates. The illustrated shroud 78 can optionally include an integrally molded or formed bearing 16 to reduce the total number of parts in the cleaning head subsystem. The bearing 16 need not, however, be integrally molded or formed in the shroud 78 and may be provided as a separate piece. The bearing 16 allows the brush shaft 64 to rotate substantially freely when mounted in the cleaning head compartment. If an integrally molded or formed bearing 16 is used with the shroud 78, an axle (or shaft) 64 of the brush 60 is inserted into an aperture in the shroud/bearing. When the bearing 60 is provided separate from the shroud 78, the brush shaft 64 can be inserted in the bearing 60 and then the bearing 60 can be inserted in the shroud 78, or the bearing 60 can be inserted in the shroud 78 before the shaft 64 is inserted into the bearing 60.

A shaft housing 70 can surround the axle (or shaft) 64 adjacent at least the bearing end 14 of the brush 60 and include a first flange 72 and a second flange 74 with a recessed area 73 therebetween. A relatively large gap 68 is formed between the first flange 72 of the shaft housing 70 and an adjacent interior surface of the shroud 78. This gap 68 can allow hair and similar matter to enter the recessed area 73 of the shaft housing 70 that is located between the first flange 72 and the second flange 74, providing a location at the recessed area 73 for hair and similar matter to collect where the hair and similar matter will not stall the robotic vacuum. A short labyrinth passage 34 between an exterior surface of the shaft housing 72 and a complementary interior surface of the shroud 78 from the large gap 68 to the recessed area 73 provides a short passage at a large outer diameter of the shaft housing 72. The short length of the passage 34 ensures that minimal torque is required by minimizing the likelihood of hair and other matter getting stuck, as discussed above, if any hair or similar matter enters the shroud. The shaft housing cap 70 includes protrusions 76 extending from the second flange 74 into recesses 79 in the shroud 78 interior. As passage from the gap 68 into the recessed area 73 and around the protrusions 79 into the recesses 79 is long and difficult, additional protection is provided for the bearing 16.

Figure 6:
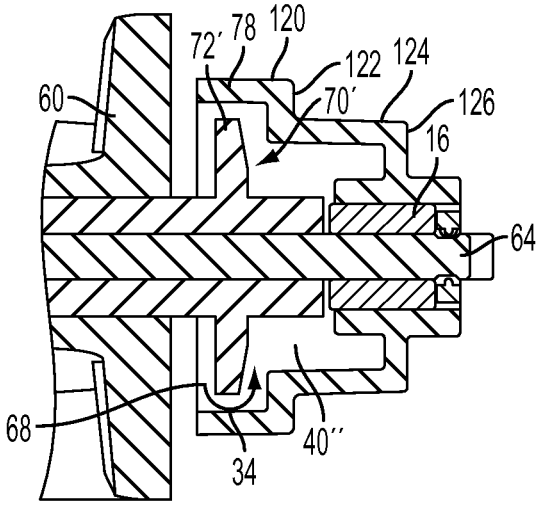

FIG. 6 illustrates an alternative embodiment of the shroud employed to cover at least the bearing end of one or more of the main brush and the flapper brush of a cleaning head subsystem. The structure of the bearing 16, shroud 78 and axle or shaft 64 is similar to that disclosed in FIG. 5. In FIG. 6, a shaft housing 70' that includes a sleeve and a guard 72' is provided. The guard 72' extends from the sleeve portion of the shaft housing 70' toward the shroud 78. The shroud 78 includes a first wall 120 extending parallel to the shaft 64, a second wall 122 extending generally perpendicular to the first wall 120, a third wall 124 extending generally perpendicular to the second wall 122, and a fourth wall 126 extending generally perpendicular to the third wall 124. A recess 68 is formed between the guard 72' and the brush 60. Hair collects between the flapper brush 60 and the guard 72' and provides a dam which prevents hair entry into the shroud 78 once initial buildup has occurred. A labyrinth passage 34 is formed from the recess 68 between the guard 72' and the shroud 78 interior at first wall 120 and to a reservoir 40". The reservoir 40" receives hair through the labyrinth passage 34 and is relatively large, being defined between a portion of the first wall 120 of the shroud 78, the second wall 122, the third wall 124 and the fourth wall 126. The reservoir 40" provides a location for hair and other matter to collect.

One skilled in the art will appreciate that a shroud as illustrated in FIGS. 1-4 or FIGS. 5 and 6 can be employed in a similar manner on the drive end of one or more of the main brush or the flapper brush in accordance with the present teachings.

Figure 7A:
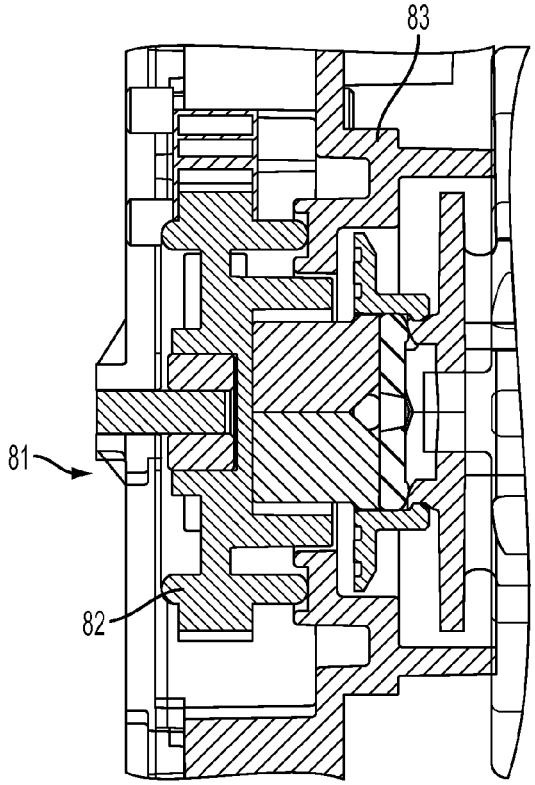
FIGS. 7A and 7B are cross-sectional views of exemplary embodiments of a drive end portion and a bearing end portion, respectively, of a brush for a robotic vacuum in accordance with the present teachings.
Figure 7B:
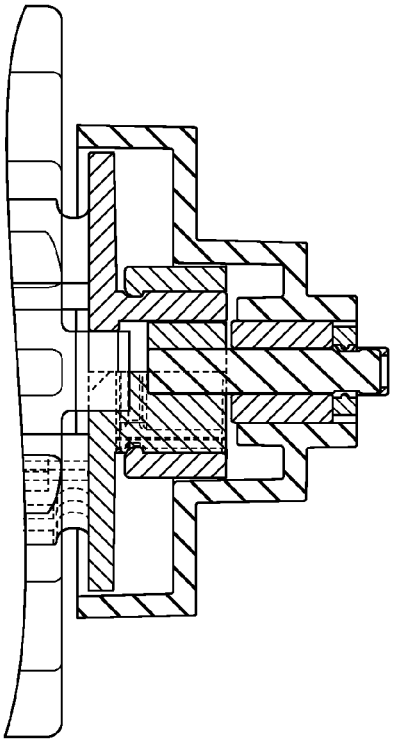

FIGS. 7A and 7B are cross-sectional views of at least one embodiment of a drive end portion and a bearing end portion, respectively, of a brush for a robotic vacuum in accordance with the present teachings. In general, it is preferable for hair and other matter to collect in the bearing end (see FIG. 7B) of the brush instead of being fed into the gearbox of the brush's drive end (see FIG. 7A). Therefore, in a preferred embodiment, the drive end portion shown in FIG. 7A includes an embodiment of the shroud shown with a guard, for example, guard 52 or 52' in FIGS. 2 and 3, while the bearing end portion shown in FIG. 7B includes an embodiment with only the sleeve, for example, sleeve 50" in FIG. 4. As the addition of the guard provides additional protection for the gearbox and as the bearing end does not include a guard, in this embodiment, the hair and other matter tend to migrate away from the drive end (FIG. 7A) and toward the bearing end (FIG. 7B), which is preferable to avoid gearbox failures and to direct the hair and other matter to the end at which a user is able to clean the brushes. As the bearing end preferably does not include the guard, more hair and other matter tend to migrate into the bearing end and be collected in reservoir(s) in the bearing end.

The drive end of the brush includes a gearbox 81 having a gear 82. A shroud 83 surrounds the drive end of the brush and is incorporated into the gearbox 81 at the drive end (see FIG. 16, for example). A continuous stationary shroud housing allows for full 360 degree rotation of the brushes within the stationary shroud. However, it is noted that a shroud need not provide a full 360 degree rotation and may provide less than 360 degrees of rotation for received brushes. Because breaks in the shroud surface promote catching of hair, it is preferable for the gearbox housing to have a single continuous shroud within breaks in the shroud surface.

Figure 8A:
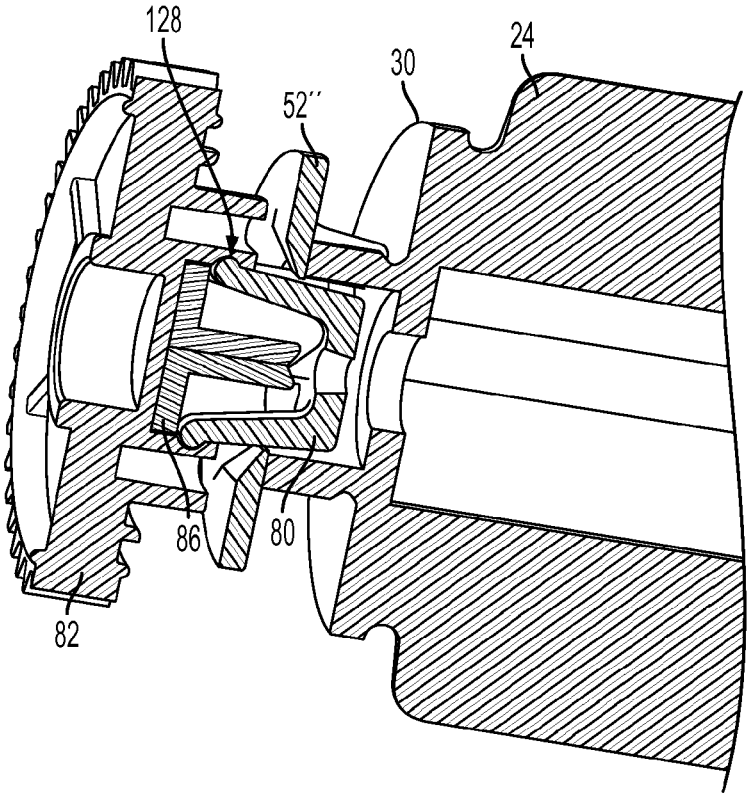
FIG. 8A is a perspective cross-sectional view of an exemplary embodiment of a drive end portion of a brush, including a retention device in accordance with the present teachings.
Figure 8B:
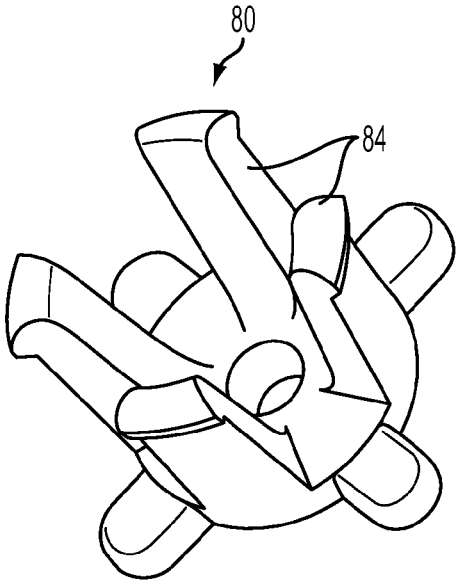
FIG. 8B is a perspective view of the retention device of FIG. 8A in accordance with the present teachings.

FIG. 8A is a perspective cross-sectional view of a drive end portion of a brush connected with a drive gear of the cleaning head, including a retention device in accordance with the present teachings, and FIG. 8B is a perspective view of the retention device of FIG. 8A in accordance with the present teachings. In FIG. 8A, a retention device 80 is shown housed internal to the cage 24 of the brush 10. While the retention device 80 is shown attached to the main brush 10, it will be understood by one of ordinary skill in the art that the retention device may also be utilized with a flapper brush. The retention device 80 is positioned between a circular flange 30 and a gear 82 to lock the brush to the gear 82. A sleeve 50''' having a guard 52" extending from the sleeve 50''' may be provided between the circular flange 30 and the gear 82.

The retention device 80 may be, for example, an internal snapping device that is able to be retained to the gear 82. The retention device 80 may include a plurality of interlocking members 84 extending away from the cage 24 when the retention device 80 is in an engaged position. The retention device 80 is internally disposed between the sleeve 50''' and the guard 52" and is received within a drive protrusion 86. When the drive protrusion 86 is inserted into a main recess of the gear 82 (see also gear 120 in FIG. 17), the interlocking members 84 are each received into a reception recess 128 within the interior of the gear 82. The retention device 80 limits the axial motion of the brush 10 toward its bearing end, which reduces the ability of hair and debris to enter the drive end of the brush by reducing gaps at the drive end.

Figure 16:
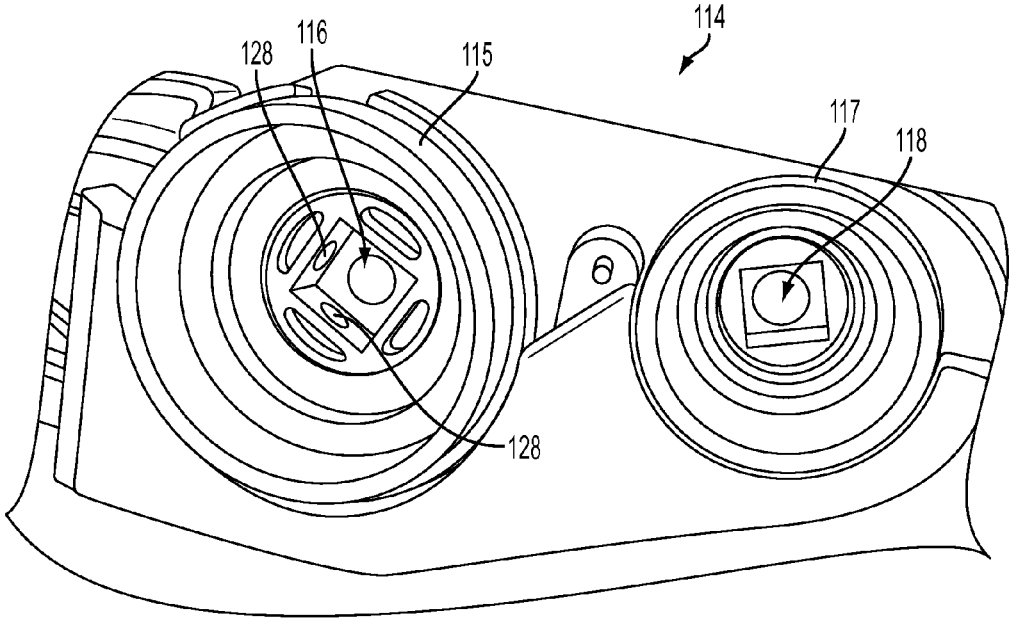
FIG. 16 is a front view of the drive end of the cleaning head compartment in accordance with the present teachings.
Figure 17:
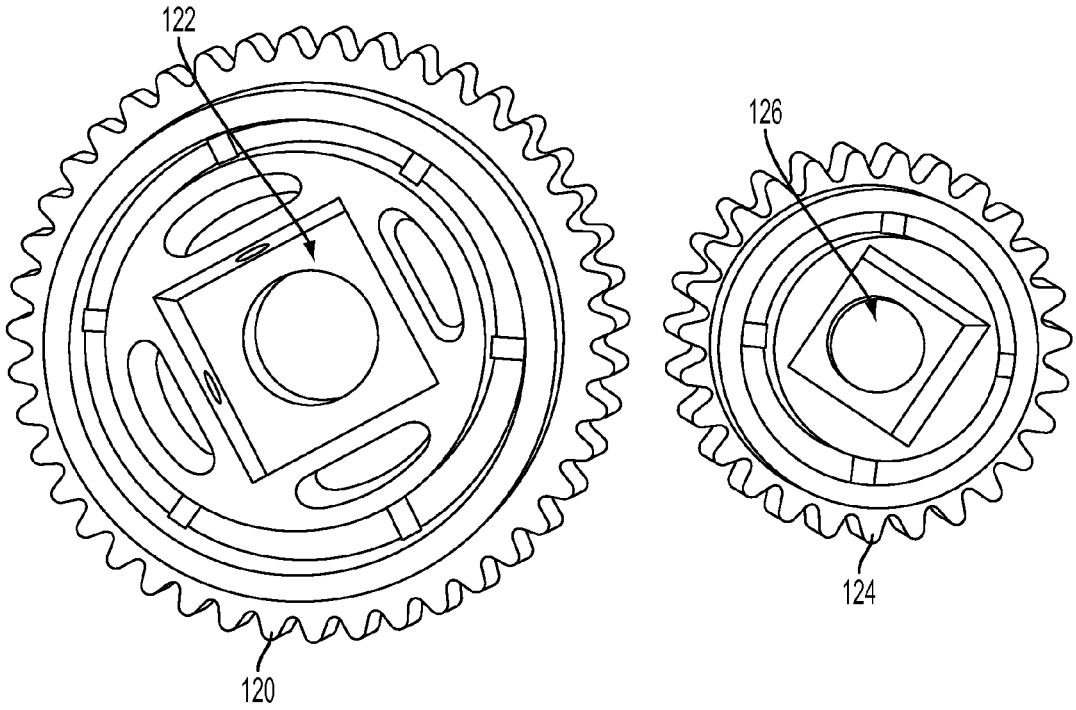
FIG. 17 is a top view of gears for the main brush and the flapper brush in accordance with the present teachings.

The drive protrusion 86 can engage a gear recess, such as, e.g., gear recess 122 for gear 120 shown in FIGS. 16 and 17, which is disposed within a shroud head 114 including a shroud portion, such as shroud 115 for the main brush 10 and a shroud portion, such as shroud 117 for the flapper brush 60, as shown in FIG. 16, for example. While the gear 120 shown in FIG. 17 and similarly shown as gear 82 in FIG. 8A, which are used with the main brush 10, is illustrated in connection with the retention device 80, it may be understood by those of ordinary skill that the retention device 80 may also or alternatively be used with the flapper brush 60 and thus may be used with the gear 124 engaged with the shroud 117 and having a gear recess 126.

In addition, although the retention device 80 is shown being housed internal to the brush cage 24 with the interlocking members 84 being retained by reception recesses 128 within the gear 82, one of ordinary skill would recognize that the retention device could alternatively be provided at the gear 82, with corresponding reception recesses located at the brush cage 24 to be retained at the brush end.

Figure 9:
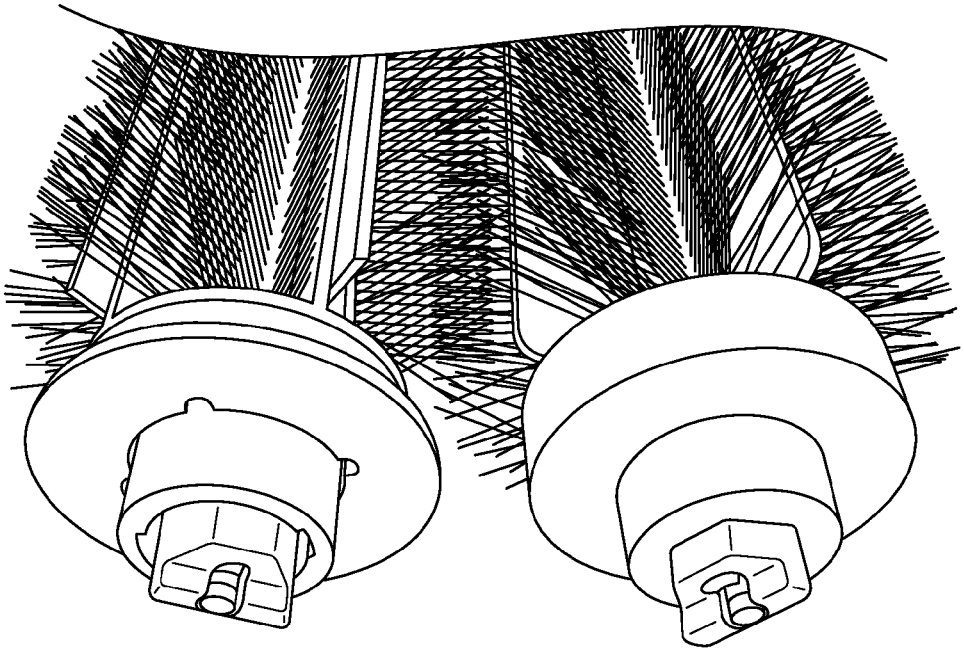
FIG. 9 is a perspective view of a bearing end portion of an existing robotic vacuum brush (left) and an embodiment of a bearing end portion of a robotic vacuum brush in accordance with an exemplary embodiment of the present teachings (right).

Certain embodiments of the present teachings contemplate providing a shrouded end for a brush as set forth in the above exemplary embodiments, which has a size and shape allowing it to be backward compatible with existing cleaning heads. FIG. 9 shows how a bearing end of a shrouded main brush (right) can be sized and shaped like a bearing end of an existing non-shrouded main brush (left) for backward compatibility with existing cleaning heads into which the bearing end of the main brush is mounted, noting that a third wall and a fourth wall (such as walls 48 and 49 shown in FIG. 1, for example).

Figure 10A:
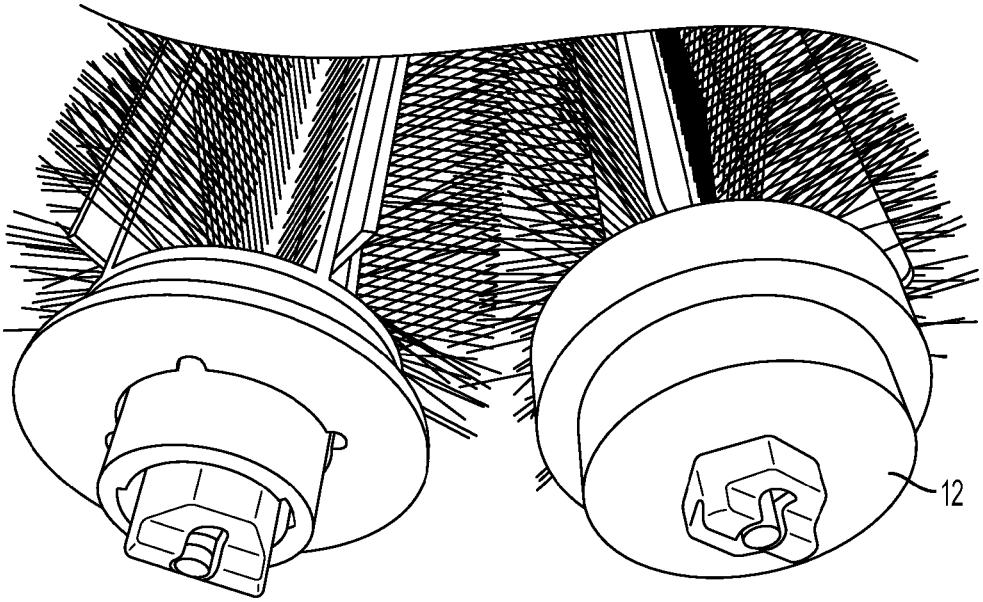
FIG. 10A is a perspective view of a bearing end portion of an existing robotic vacuum brush (left) and an embodiment of a bearing end portion of a robotic vacuum brush in accordance with an exemplary embodiment of the present teachings (right).
Figure 10B:
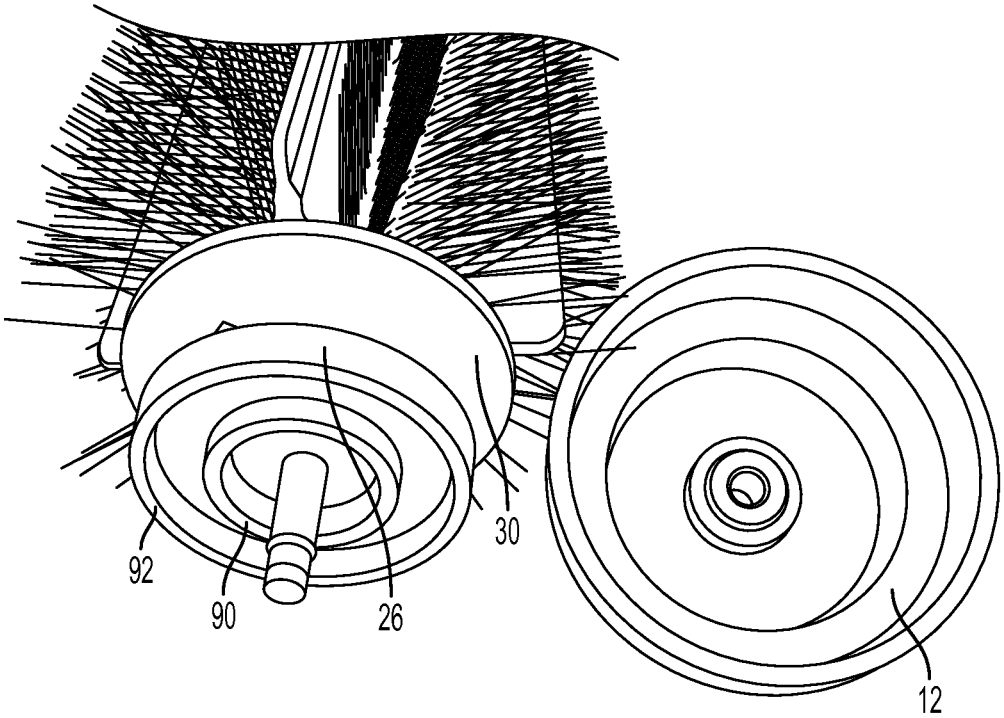
FIG. 10B is a perspective view of the brush bearing end portion embodiment shown on the right side of FIG. 10A, with the shroud removed.

FIG. 10A shows an embodiment of a bearing end of a shrouded main brush (right) with improved hair-resistance properties but which is not backward compatible with existing cleaning heads because it does not have the same size and shape as existing main brush bearing ends (left). The shroud, which may be similar to shroud 12 in FIG. 1, for example, is larger because the brush guard includes a non-removable guard 26 with a large diameter (and optionally with both a first protrusion 90 and a second protrusion 92 for engagement with a second recess of the shroud to form an additional labyrinth) as illustrated in FIG. 10B. An alternative embodiment can include, for example, a shroud that has a third wall and a fourth wall (such as walls 55 and 57 in FIG. 2, for example) that are sized to define a relatively larger diameter than the diameter of the third and fourth walls shown in FIG. 9.

Figure 11A:
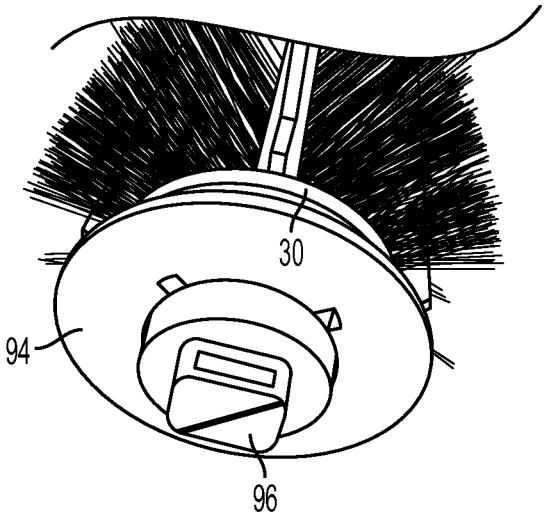
FIG. 11A is a perspective view of a drive end portion of an existing robotic vacuum brush.
Figure 11B:
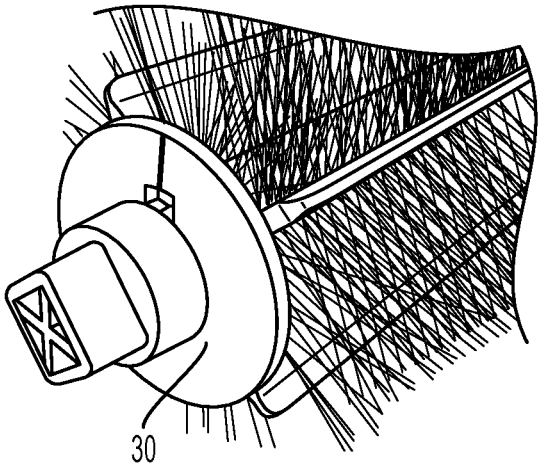
FIG. 11B is a perspective view of an embodiment of a drive end portion of a robotic vacuum brush in accordance with the present teachings.
Figure 11C:
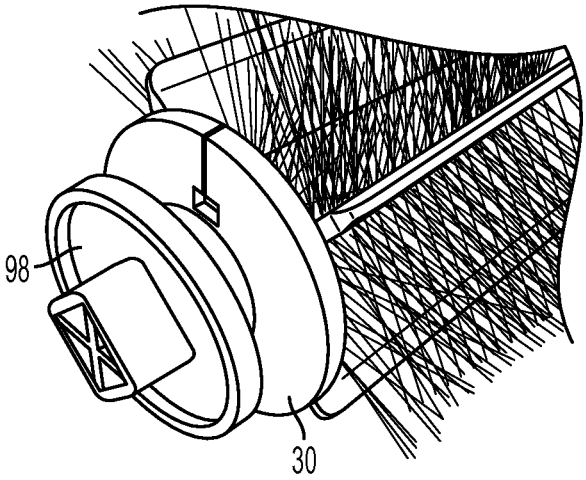
FIG. 11C is a perspective view of an embodiment of a drive end portion of a robotic vacuum brush in accordance with the present teachings.

FIG. 11A shows a drive end of an existing main brush, FIG. 11B shows an embodiment of a drive end of a main brush in accordance with the present teachings, and FIG. 11C shows another embodiment of a drive end of a main brush in accordance with the present teachings. As shown, the drive end of the brush can include a drive protrusion 96, e.g., a square-shaped drive protrusion, for engagement with a complementary recess 122 (shown in FIG. 17) of the cleaning head compartment's brush drive mechanism. A removable guard 94 or end cap as illustrated in FIG. 11A can be provided between the square-shaped drive protrusion 96 and a brush cage 24 in the existing brush drive end illustrated in FIG. 11A or in the embodiment of FIG. 11B. The embodiment of FIG. 11B can allow a wider recessed area between a removable end cap and the circular flange 30 of the cage 24, providing a larger area for hair and similar matter to collect where it will not stall the robotic vacuum.

FIG. 11C shows an embodiment of a vacuum brush in accordance with the present teachings that includes a non-removable guard 98 having a protruding lip at its outer perimeter and creating a wide recessed area between the non-removable guard 98 and the circular flange 30 of the cage 24, providing a larger area for hair and similar matter to collect where it will not stall the robotic vacuum. Due to the diameter of the illustrated non-removable guard, this brush embodiment may not be backward compatible with existing cleaning heads.

Figure 12B:
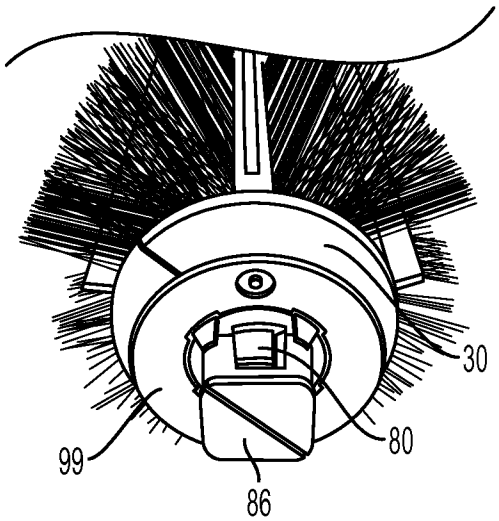
FIG. 12B is a front perspective view of an embodiment of a drive end portion of a robotic vacuum brush in accordance with the present teachings.
Figure 12A:
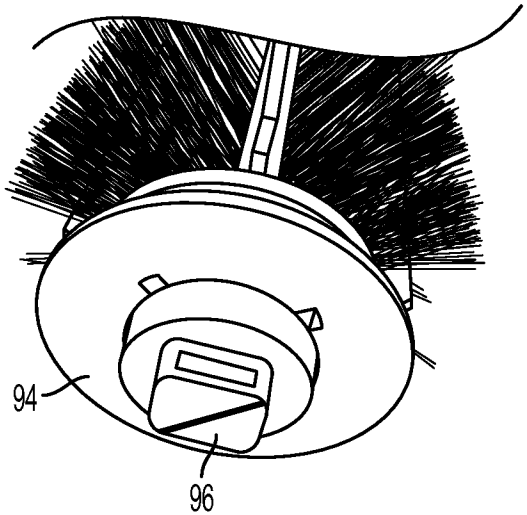
FIG. 12A is a front perspective view of a drive end portion of an existing robotic vacuum brush.

FIG. 12A is a front perspective view of a drive end portion of an existing robotic vacuum brush corresponding to FIG. 8A discussed above, and FIG. 12B is a front perspective view of an embodiment of a drive end portion of a robotic vacuum brush in accordance with the present teachings. The existing brush shown in FIG. 12A includes a removable guard 94 and a square drive protrusion 96. In contrast, the brush according to the present teachings shown in FIG. 12B includes a non-removable sleeve (not visible in FIG. 12A) with a guard 99 extending therefrom. The retention device 80 can be seen through an aperture in the illustrated drive end protrusion 86.

Figure 13:
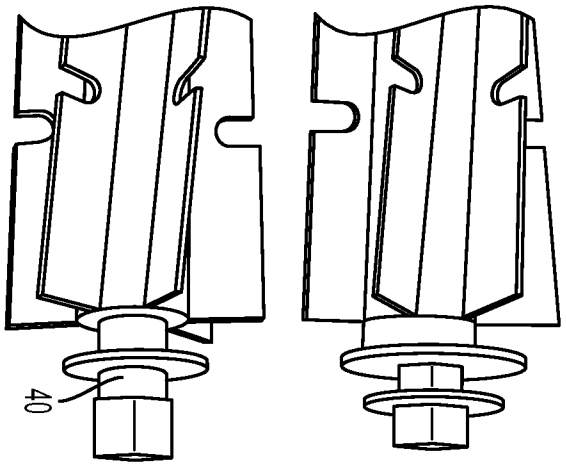
FIG. 13 is a side perspective view of an exemplary embodiment of an end portion of a robotic vacuum flapper brush (top) and a side perspective view of another exemplary embodiment of an end portion of a robotic vacuum brush in accordance with the present teachings (bottom).

FIG. 13 is a side perspective view of an exemplary embodiment of an end portion of a robotic vacuum flapper (top) and a side perspective view of another exemplary embodiment of an end portion of a robotic vacuum flapper (bottom). The drive end of the flapper brush is shown. The top flapper brush may include two flange or guard portions, while the bottom flapper brush may include a single flange or guard portion between the central member of the brush and the drive protrusion, with a reservoir 40 being defined between the single flange or guard portion and the shroud when the shroud is installed over the drive end of the flapper brush. It may be preferable to include a single flange or guard because the accumulation of the hair and other matter between the guards may cause melting of parts due to the increased humidity due to hair buildup.

Figure 14A:
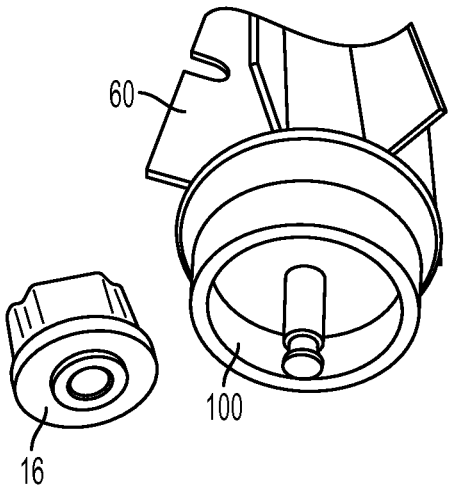
FIG. 14A is a perspective view of a bearing end portion of an existing flapper brush, with the bearing removed from the brush axle.
Figure 14B:
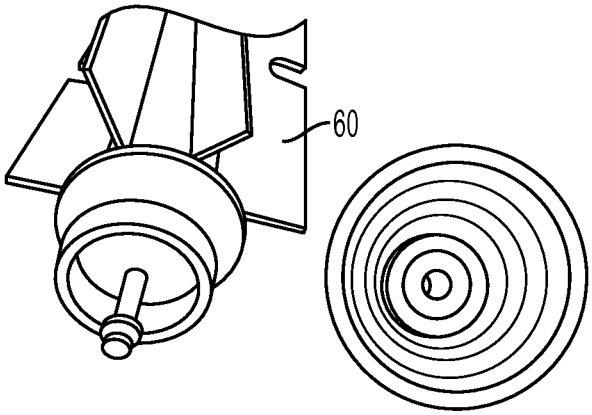
FIG. 14B is a perspective view of an embodiment of a bearing end portion of a brush with the shroud removed from the brush axle.
Figure 14C:
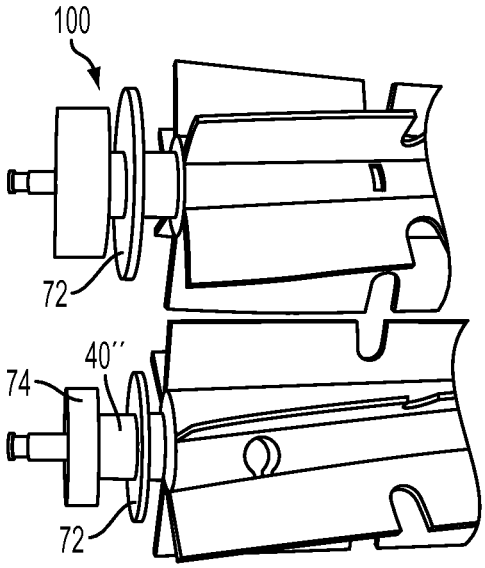
FIG. 14C is a top view providing a comparison of an existing robotic vacuum brush bearing end portion (top) and an embodiment of a robotic vacuum brush bearing end portion in accordance with the present teachings (bottom).

FIG. 14A illustrates an existing bearing end of a flapper brush. The bearing 16 is shown detached, but can be inserted on the axle or shaft and seated within a recess of an end piece 100 of the flapper brush 60. FIG. 14B illustrates an embodiment of a flapper end piece, which may be similar to the shaft housing 70 or 70' shown in FIGS. 5 and 6 in accordance with the present teachings, similar to or the same as the embodiment shown in cross section and discussed with respect to FIGS. 5 and 6, including a bearing 16 that is integrally molded or formed with a shroud, such as shroud 78 or 78' in FIGS. 5 and 6, for example. FIG. 14C provides a comparison between an existing bearing end (top) of a flapper brush and the embodiment of FIG. 11B (bottom), which shows a smaller size of a secondary guard (such as secondary guard 74, shown in FIG. 5, for example), but a larger reservoir (for example, recessed area 73 shown in FIG. 5 or reservoir 40" shown in FIG. 6) between the main guard 72 and the secondary guard 74 to hold hair and similar matter that has entered an interior of the shroud.

As stated above, certain embodiments of the present teachings contemplate a shroud provided for a drive end of the flapper brush, or an increased reservoir size for the flapper brush drive end.

Figure 15:
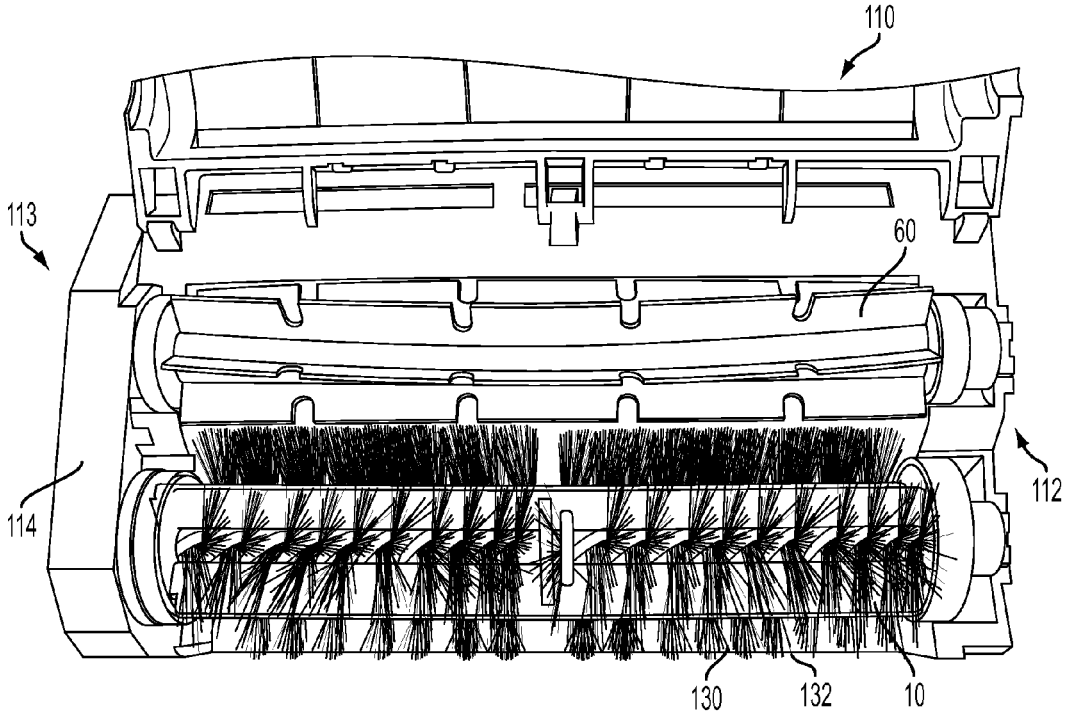
FIG. 15 is a front view of a cleaning head compartment in accordance with the present teachings.

FIG. 15 illustrates a cleaning head subsystem for a robotic vacuum with brushes having ends configured in accordance with various embodiments of the present teachings. FIG. 15 illustrates the cleaning head compartment 110 having a bearing end 112 and a drive end 113, with main 10 and flapper 60 brushes mounted therein, the bearing end 112 of the main 10 and flapper 60 brushes being shrouded in accordance with the present teachings and the drive end 113 of the brushes being provided with a shrouded gearbox housing 114 at the gearbox 81. It will be understood by one of ordinary skill in the art that any of the embodiments described above may be installed within the cleaning head compartment 110. The shrouded gearbox housing 114 including the gearbox 81 may be divorced from the cleaning head compartment 110 so that, for example, the shrouded gearbox may be able to be manufactured separately from the cleaning head compartment 110.

In addition, as shown in FIG. 15, the main brush 10 may include two sets of bristles 130, 132. A first set of bristles 130 may have a relatively larger diameter than a second set of bristles 132. More of the second set of bristles 132 may be provided, which provides more floor contact due to the increased number of bristles. Two bristle diameter types are provided to be able to pick up different types of materials. In an embodiment, approximately 70% of the second set of bristles may be provided, while approximately 30% of the first set of bristles may be provided. It will be understood to one of ordinary skill, however, that the percentages may be variable. In addition, the first set of bristles 130 may have a diameter of 0.2 mm, while the second set of bristles may have a diameter of 0.1 mm.

FIG. 16 is a front perspective view of an exemplary embodiment of a shrouded gearbox housing 114 for use on a drive end of a robotic vacuum cleaning head compartment in accordance with certain embodiments of the present teachings. Using the illustrated embodiment, the shrouding can be located on the gearbox rather than on the drive end of the flapper and brush engaged therewith to be driven. A partial cross section of the shrouded gearbox housing 114 can be seen in FIG. 7A and include a shroud 115 located around the main brush drive recess 116 and a shroud 117 located around the flapper brush drive recess 118. As seen in FIG. 16, for example, a plurality of reception recesses 128 may be disposed within the gear so that the gear is able to retain the retention device 80.

FIG. 17 is a top view of gears for the main brush and the flapper brush in accordance with the present teachings. FIG. 17 shows an exemplary embodiment of a gear 120 for the main brush, which may be similar to gear 82 of FIG. 8A, and an exemplary embodiment of a gear 124 for the flapper brush. The main brush gear 120 includes a gear recess 122, and the flapper brush gear 124 includes a gear recess 126. The main brush gear recess 122 is relatively larger than the flapper brush gear recess 126 as the drive protrusion for the main brush includes the retention device, which increases the size of the drive protrusion to be received into the gear recess 122. While it is shown and described to include the retention device 80 as part of the main brush 10 and received in the main brush gear 122, it will be understood by those of ordinary skill in the art that the flapper brush may additionally or alternatively include the retention device 80 and the recess 126 of the flapper brush gear 124 may have an increased size in this case due to the increased size of the drive protrusion including the retention device 80. As discussed above, a plurality of reception recesses 128 may be provided within the gear recess 122 in order to be able to retain the interlocking members 84 of the retention device 80.

Figure 18:
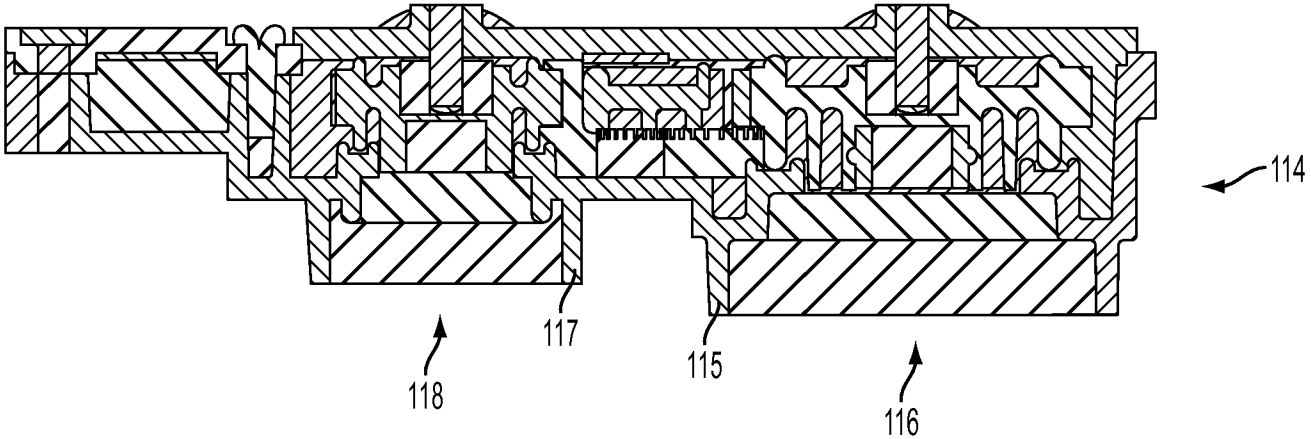
FIG. 18 is a cross-sectional view of the shrouded drive end of the cleaning head compartment in accordance with the present teachings.

FIG. 18 is a cross-sectional view of the divorced shrouded gearbox shown in FIG. 7A, for example. The shrouded gearbox 114 includes the shroud 115 located around the main brush drive recess 116 and the shroud 117 located around the flapper brush drive recess 118.

Figure 19A:
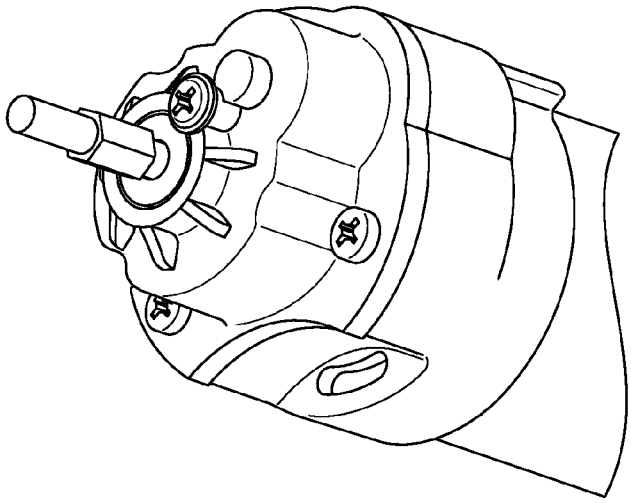
FIG. 19A is a perspective view of an existing motor.
Figure 19B:
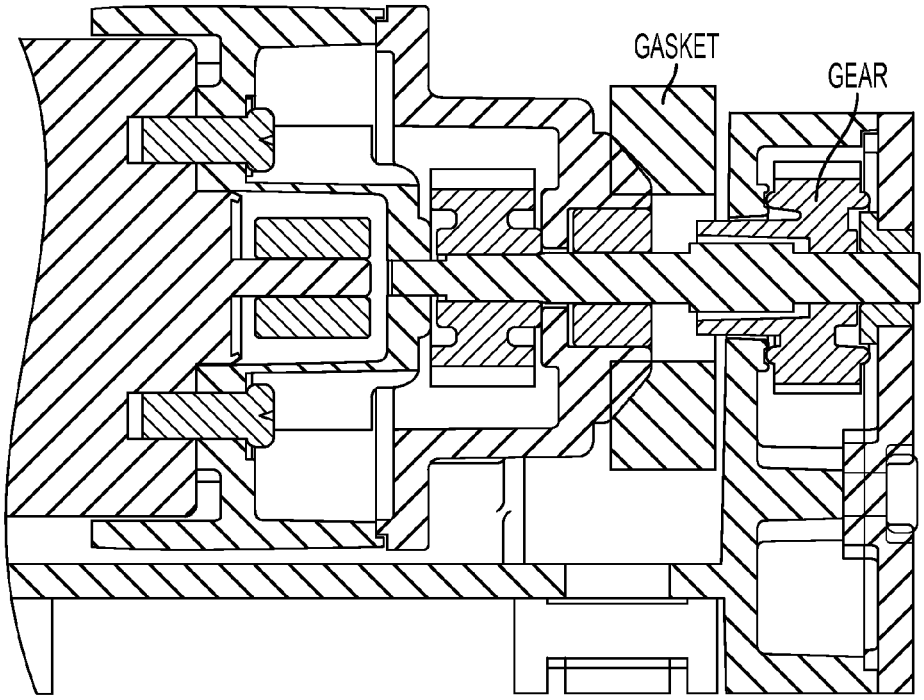
FIG. 19B is a cross-sectional view of the existing motor.
Figure 20A:
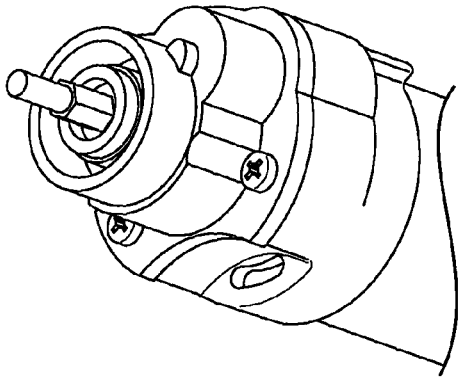
FIG. 20A is a perspective view of a shrouded motor in accordance with the present teachings.
Figure 20B:
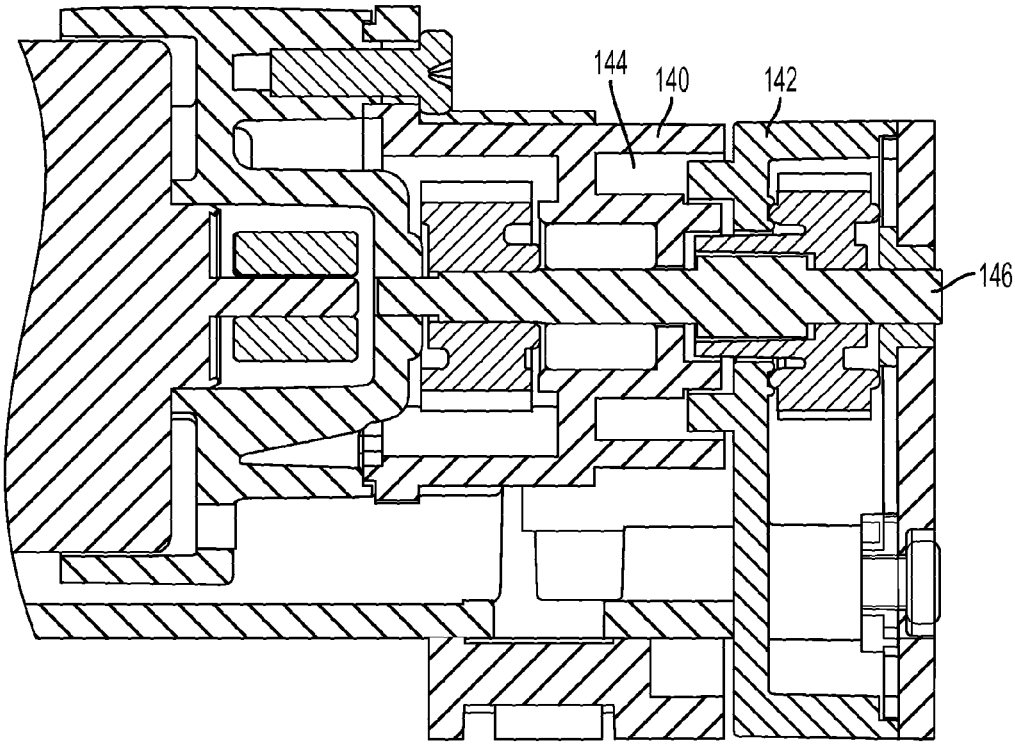
FIG. 20B is a cross-sectional view of the shrouded motor of FIG. 20A in accordance with the present teachings.
Figure 21:
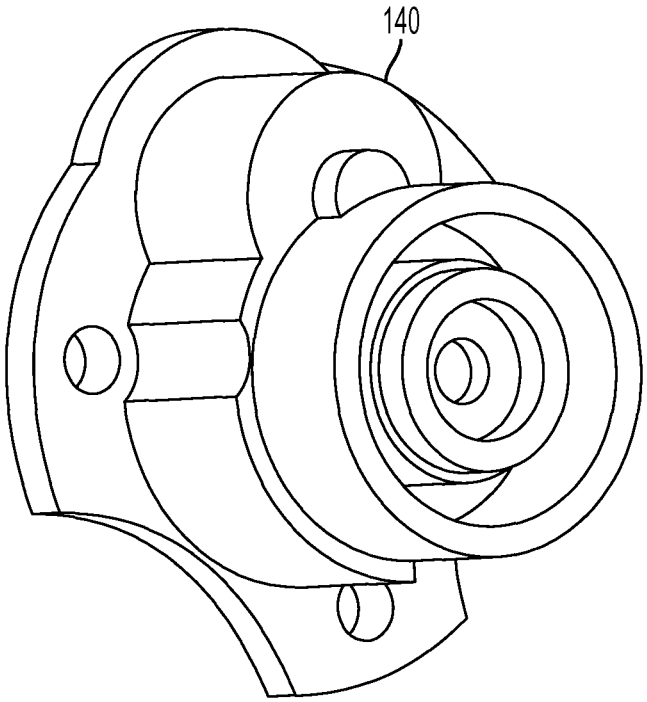
FIG. 21 is an exterior perspective view of the shroud for the motor shown in FIGS. 20A and 20B.

FIG. 19A is a perspective view of an existing motor, and FIG. 19B is a cross-sectional view of the existing motor. FIG. 20A is a perspective view of a shrouded motor in accordance with the present teachings, and FIG. 20B is a cross-sectional view of the shrouded motor of FIG. 20A in accordance with the present teachings. The motor shown in FIG. 20B includes a shroud 140 that engages with a gearbox housing 142, with a shaft 146 extending therethrough. A recessed collection area 144 is provided within interior of the shroud 140 and is able to additionally collect hair and other matter before the hair and other matter are able to migrate to the motor. FIG. 21 is an exterior perspective view of the shroud 140 for the motor shown in FIGS. 20A and 20B.

Other embodiments of the present teachings will be apparent to those skilled in the art from consideration of the specification and practice of the teachings disclosed herein. For example, the present teachings apply to a robotic vacuum having a single brush or a single brush having a structure in accordance with the present teachings, and to robotic vacuums having more than two brushes. In addition, the present teachings apply generally to rotating cleaning elements for a robotic vacuum that are configured to lift debris from the floor. The rotating cleaning elements can include a brush, a flapper, or a similar device. It is intended that the specification and examples be considered as exemplary only, with a true scope and spirit of the present teachings being indicated by the following claims.

What is claimed is:

1. A rotating cleaning element configured to be inserted in a cleaning head compartment of a robotic vacuum, the rotating cleaning element comprising:

a drive end comprising a drive protrusion configured to engage a drive mechanism of the cleaning head compartment and a retention device configured to limit axial motion of the cleaning element, the retention device including interlocking members configured to engage one or more recess in a drive gear that engages the drive protrusion;

a bearing end and a shroud configured to surround at least a portion of the bearing end to lessen an amount of hair and similar matter that reaches the bearing, wherein the shroud comprises:

a first wall disposed generally parallel to a central axis of a central member;

a second wall extending generally perpendicular from the first wall;

a third wall extending generally perpendicular from the second wall; and a fourth wall extending generally perpendicular from the third wall, the first, second, third and fourth wall defining the interior of the shroud; and the central member extending between the bearing end and the drive end;

wherein each interlocking member has a proximal end attached to the central member and extends to an unattached distal end defining a retention feature configured to releasably engage a recess defined by the drive end of the cleaning element.

2. The rotating cleaning element of claim 1, wherein the bearing end of the rotating cleaning element further comprises a cylindrical sleeve surrounding a shaft of the rotating cleaning element, a circular flange adjacent the central member of the rotating cleaning element and extending radially outwardly from the sleeve of the central member, and a recess between a portion of the central member and the circular flange.

3. The rotating cleaning element of claim 2, wherein a reservoir into which the hair and similar matter is collected is defined between the circular flange, the first wall of the shroud, the second wall of the shroud, and the sleeve.

4. The rotating cleaning element of claim 3, further comprising a labyrinth passage between the recess and the reservoir, the labyrinth passage being a path between the recess and the reservoir at an outer diameter of the circular flange.

5. The rotating cleaning element of claim 2, further comprising a guard extending outwardly from the sleeve to an interior wall of the shroud.

6. The rotating cleaning element of claim 5, wherein the circular flange, the guard and the shroud define a first reservoir into which the hair and similar matter is collected.

7. The rotating cleaning element of claim 6, wherein the guard extends from the sleeve radially outwardly to the third wall of the shroud, the first reservoir being defined between the circular flange, the first wall of the shroud, the second wall of the shroud, a portion of the third wall of the shroud, the guard, and the sleeve.

8. The rotating cleaning element of claim 6, wherein the guard extends from the sleeve radially outwardly toward the third wall of the shroud, the first reservoir being defined between the circular flange, the first wall of the shroud, the second wall of the shroud, the guard, and the sleeve.

9. The rotating cleaning element of claim 6, further comprising a first labyrinth passage between the recess and the first reservoir, the first labyrinth passage being a path between the recess and the first reservoir at an outer diameter of the circular flange.

10. The rotating cleaning element of claim 9, wherein the guard, the sleeve and the shroud define a second reservoir into which the hair and similar matter is collected.

11. The rotating cleaning element of claim 10, further comprising a second labyrinth passage between the first reservoir and the second reservoir, the second labyrinth passage being a path between the first reservoir and the second reservoir at an outer diameter of the guard.

12. The rotating cleaning element of claim 1, wherein the rotating cleaning element is one of a main brush and a flapper brush.

13. A cleaning head subsystem for a robotic vacuum, the cleaning head subsystem including a cleaning head compartment and at least one cleaning element, the cleaning element comprising:

a bearing end and a first shroud configured to surround at least a portion of the bearing end and a sleeve thereof;

a first reservoir being defined at least between a portion of the first shroud and the sleeve;

a drive end comprising a drive protrusion configured to engage a drive mechanism of the cleaning head compartment and a retention device configured to limit axial motion of the cleaning element, the retention device including interlocking members configured to engage one or more recess in a drive gear that engages the drive protrusion; and a central member extending between the bearing end and the drive end;

wherein the drive end includes a second shroud configured to surround at least a portion of the drive end and at least one guard extending radially outwardly from a central axis of the central member toward an interior of the second shroud, a second reservoir being defined at least between a portion of the second shroud and the guard; and wherein each interlocking member has a proximal end attached to the central member and extends to an unattached distal end defining a retention feature configured to releasably engage a recess defined by the drive end of the cleaning element.

14. A cleaning head subsystem for a robotic vacuum, the cleaning head subsystem comprising:

a cleaning head compartment;

a cleaning element assembly disposed within the cleaning head compartment, the cleaning element assembly including a main brush and a flapper brush; and a gearbox comprising a main brush drive gear to drive the main brush, a flapper brush drive gear to drive the flapper brush, and a first shroud configured to surround at least one of the main brush drive gear and the flapper brush drive gear;

wherein the shroud comprises:

a first wall disposed generally parallel to a central axis of a central member of the cleaning element;

a second wall extending generally perpendicular from the first wall;

a third wall extending generally perpendicular from the second wall; and a fourth wall extending generally perpendicular from the third wall, the first, second, third and fourth wall define the interior of the shroud.

15. The cleaning head subsystem of claim 14, further comprising a second shroud configured to surround the other of the main brush drive gear and the flapper brush drive gear.

16. The cleaning head subsystem of claim 15, wherein the first shroud is disposed over a drive end of the main brush in an installed position of the main brush, and the second shroud is disposed over a drive end of the flapper brush in an installed position of the flapper brush.

17. The cleaning head subsystem of claim 14, further comprising a motor to drive the gearbox, and a third shroud extending between the motor and the gearbox.

18. The cleaning head subsystem of claim 17, wherein the third shroud cooperates with the gearbox housing to create a recessed collection area for hair and similar matter.

* * * * *

UNITED STATES PATENT AND TRADEMARK OFFICE

CERTIFICATE OF CORRECTION

PATENT NO. : 8,800,107 B2
APPLICATION NO. : 13/028996
DATED : August 12, 2014
INVENTOR(S) : Matthew Blouin It is certified that error appears in the above-identified patent and that said Letters Patent is hereby corrected as shown below:

IN THE CLAIMS:

At column 13, claim number 7, line number 63, should read "at least one guard extends".

At column 14, claim number 13, line number 41, should read "to surround at least a portion of the drive end of the brush assembly".

At column 14, claim number 14, line number 65, delete "of the cleaning element".

Signed and Sealed this
Ninth Day of December, 2014

Michelle K. Lee

Michelle K. Lee
*Deputy Director of the United States Patent and Trademark Office*